US012000666B2

(12) United States Patent
Fellows et al.

(10) Patent No.: US 12,000,666 B2
(45) Date of Patent: Jun. 4, 2024

(54) TRIGGER GROUP FOR SEMI-AUTOMATIC FIREARMS

(71) Applicant: Franklin Armory Holdings, Inc., Minden, NV (US)

(72) Inventors: Ryan Paul Fellows, San Jose, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 17/372,338

(22) Filed: Jul. 9, 2021

(65) Prior Publication Data

US 2021/0341245 A1 Nov. 4, 2021

Related U.S. Application Data

(63) Continuation of application No. 16/599,653, filed on Oct. 11, 2019, now Pat. No. 11,085,724, which is a (Continued)

(51) Int. Cl.

| | |
|---|---|
| ***F41A 19/46*** | (2006.01) |
| ***F41A 17/74*** | (2006.01) |
| ***F41A 19/10*** | (2006.01) |
| ***F41A 19/12*** | (2006.01) |
| ***F41A 19/14*** | (2006.01) |
| ***F41A 19/24*** | (2006.01) |

(Continued)

(52) U.S. Cl.

CPC ..... *F41A 19/46* (2013.01); *F41A 17/74* (2013.01); *F41A 19/10* (2013.01); *F41A 19/12* (2013.01); *F41A 19/14* (2013.01); *F41A 19/24* (2013.01); *F41A 19/43* (2013.01); *F41A 19/44* (2013.01)

(58) Field of Classification Search

CPC ..... F41A 19/46; F41A 19/45; F41A 19/09; F41A 19/10; F41A 19/16; F41A 19/06; F41A 17/46; F41A 19/14; F41A 19/12; F41A 19/43; F41A 19/24; F41A 19/44; F41A 17/74

See application file for complete search history.

(56) References Cited

U.S. PATENT DOCUMENTS

| | | | |
|---|---|---|---|
| 2,027,950 | A | 1/1936 | Young |
| 4,514,923 | A | 5/1985 | Teel |

(Continued)

*Primary Examiner* — Benjamin P Lee

(74) *Attorney, Agent, or Firm* — Bennet K. Langlotz; Langlotz Patent & Trademark Works, LLC

(57) ABSTRACT

Trigger groups for semi-automatic firearms have a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, a disconnector having a hammer engagement facility adapted to selectably engage the hammer, a disconnector control element movable between a first control position and a second control position, the disconnector being operably engaged to the disconnector control element, the disconnector operable to move in a first range of motion when the disconnector control element is in the first control position, and in a second range of motion when the disconnector control element is in the second control position.

5 Claims, 22 Drawing Sheets

Related U.S. Application Data continuation of application No. 15/368,493, filed on Dec. 2, 2016, now Pat. No. 10,480,882.

(60) Provisional application No. 62/263,447, filed on Dec. 4, 2015.

(51) Int. Cl.
*F41A 19/43* (2006.01)
*F41A 19/44* (2006.01)

(56) References Cited

U.S. PATENT DOCUMENTS

| | | | |
|---|---|---|---|
| 6,966,138 | B1 | 11/2005 | Deckard |
| 8,667,881 | B1 | 3/2014 | Hawbaker |
| 8,820,211 | B1 | 9/2014 | Hawbaker |
| 9,146,066 | B1 | 9/2015 | Cason |

FIG. 2
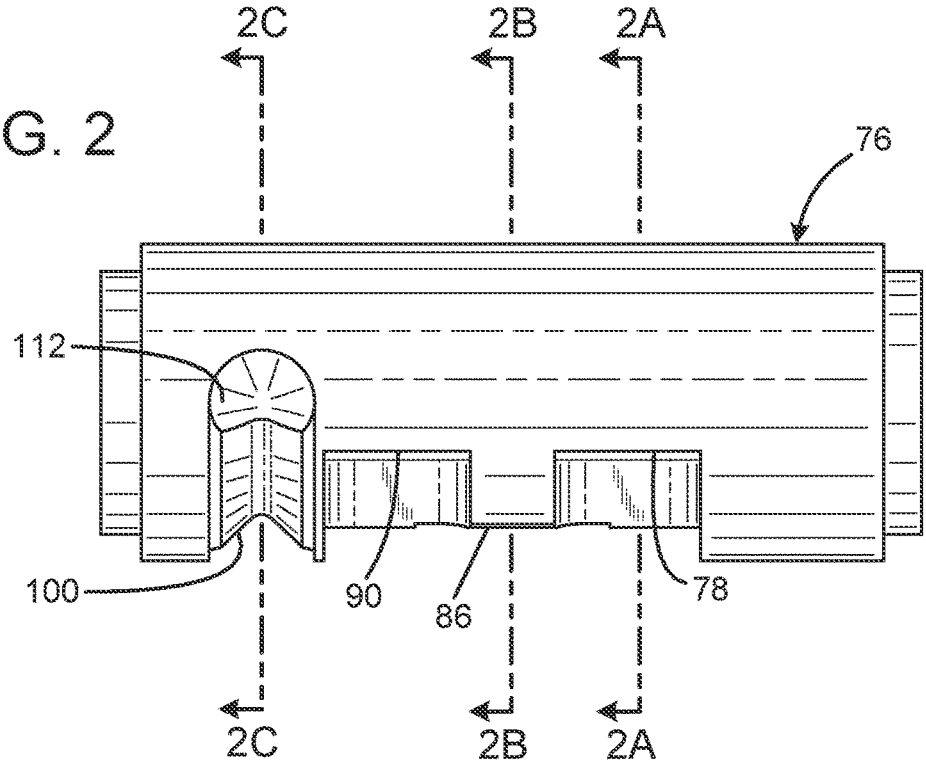
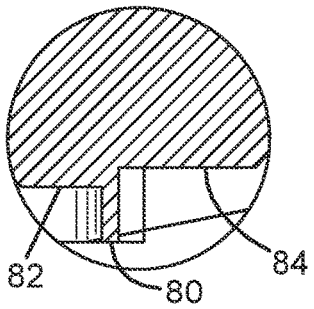
FIG. 2A
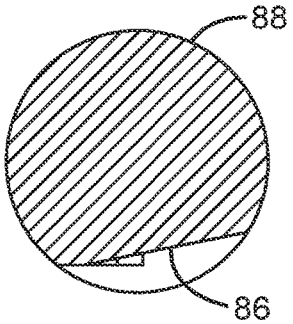
FIG. 2B
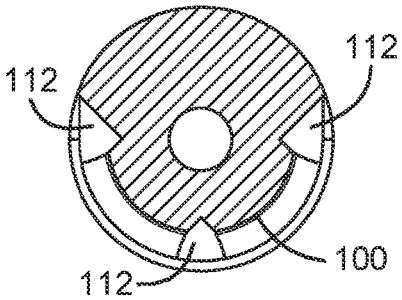
FIG. 2C

TRIGGER GROUP FOR SEMI-AUTOMATIC FIREARMS

CROSS-REFERENCE TO RELATED APPLICATION

This application is a Continuation of U.S. patent application Ser. No. 16/599,653 filed on Oct. 11, 2019, entitled "TRIGGER GROUP FOR SEMI-AUTOMATIC FIREARMS," which is a Continuation of U.S. patent application Ser. No. 15/368,493 filed on Dec. 2, 2016, entitled "TRIGGER GROUP FOR SEMI-AUTOMATIC FIREARMS," which claims the benefit of U.S. Provisional Patent Application No. 62/263,447 filed on Dec. 4, 2015, entitled "Improved Binary Firing System," which are hereby incorporated by reference in their entirety for all that is taught and disclosed therein.

FIELD OF THE INVENTION

The present invention relates to firearms, and more particularly to a trigger group for semi-automatic firearms.

BACKGROUND OF THE INVENTION

A trigger group includes all parts of the firearm that initiate the firing of the bullet. Parts include the trigger, which is usually a lever that is tripped by one or more fingers of the firing hand; the sear, which holds the hammer back until the trigger has been pulled; a disconnector, which keeps the hammer in place until the trigger is released and the sear takes over after a cycle of semi-automatic fire has occurred; and several springs throughout the group. The sear may be a separate part or can be a surface incorporated into the trigger. As the trigger is pulled, the sear slips, allowing the hammer to strike the firing pin to discharge a round.

The National Firearms Act, as interpreted by the Bureau of Alcohol, Tobacco, Firearms and Explosives Technology Branch, defines the pull of a trigger as a function, and the release of the trigger as a second function. As a result, a firearm that fires a shot upon the pull of a trigger and fires a second shot upon the release of the trigger may not be a machine gun as defined by the National Firearms Act, 26 U.S.C. 5845(b), and would not be subject to the associated legal restrictions.

An existing approach to a trigger system that fires one round with trigger pull and fires another round with trigger release is disclosed in U.S. Pat. Nos. 8,820,211 and 8,667,881 to Hawbaker. Hawbaker's trigger system provides one mode for normal semi-automatic operation and another mode that fires by pulling the trigger and fires a second round upon trigger release. However, Hawbaker's trigger system suffers from multiple disadvantages. First, Hawbaker requires two selectors with two positions each (a safety selector and a mode selector), with the mode selector being located on the trigger. The selector lever that is attached to the trigger must be manipulated within the trigger guard in order to change the mode of firing from semi-automatic to double fire. This attribute greatly increases the likelihood of an accidental discharge occurring from manipulating the selector lever. Second, once the trigger has been pulled in double fire mode, the user cannot place the firearm in safe mode, and instead must fire a second shot upon trigger release. In addition, Hawbaker's trigger must be pulled fully rearward or released fully forward to operate and utilizes two disconnectors.

Therefore, a need exists for a new and improved trigger group for semi-automatic firearms that places the selector lever outside of the trigger guard and enables the firearm to be placed in safe mode even if the trigger has been pulled in double/binary fire mode. In this regard, the various embodiments of the present invention substantially fulfill at least some of these needs. In this respect, the trigger group for semi-automatic firearms according to the present invention substantially departs from the conventional concepts and designs of the prior art, and in doing so provides an apparatus primarily developed for the purpose of providing a trigger group for semi-automatic firearms that places the selector lever outside of the trigger guard and enables the firearm to be placed in safe mode even if the trigger has been pulled in double/binary fire mode.

SUMMARY OF THE INVENTION

The present invention provides an improved trigger group for semi-automatic firearms, and overcomes the above-mentioned disadvantages and drawbacks of the prior art. As such, the general purpose of the present invention, which will be described subsequently in greater detail, is to provide an improved trigger group for semi-automatic firearms that has all the advantages of the prior art mentioned above.

To attain this, the preferred embodiment of the present invention essentially comprises a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, a disconnector having a hammer engagement facility adapted to selectably engage the hammer, a disconnector control element movable between a first control position and a second control position, the disconnector being operably engaged to the disconnector control element, the disconnector operable to move in a first range of motion when the disconnector control element is in the first control position, and the disconnector operable to move in a second range of motion different from the first range of motion when the disconnector control element is in the second control position, such that the trigger assembly operates in a first mode when the selector is in the first position, and in a second mode when in the second position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 2 is a top view of the safety selector shaft of FIG. 1.

FIG. 2A is a sectional view of the safety selector shaft taken along line 2A-2A of FIG. 2.

FIG. 2B is a sectional view of the safety selector shaft taken along line 2B-2B of FIG. 2.

FIG. 2C is a sectional view of the safety selector shaft taken along line 2C-2C of FIG. 2.

The same reference numerals refer to the same parts throughout the various figures.

DESCRIPTION OF THE CURRENT EMBODIMENT

Figure 1:
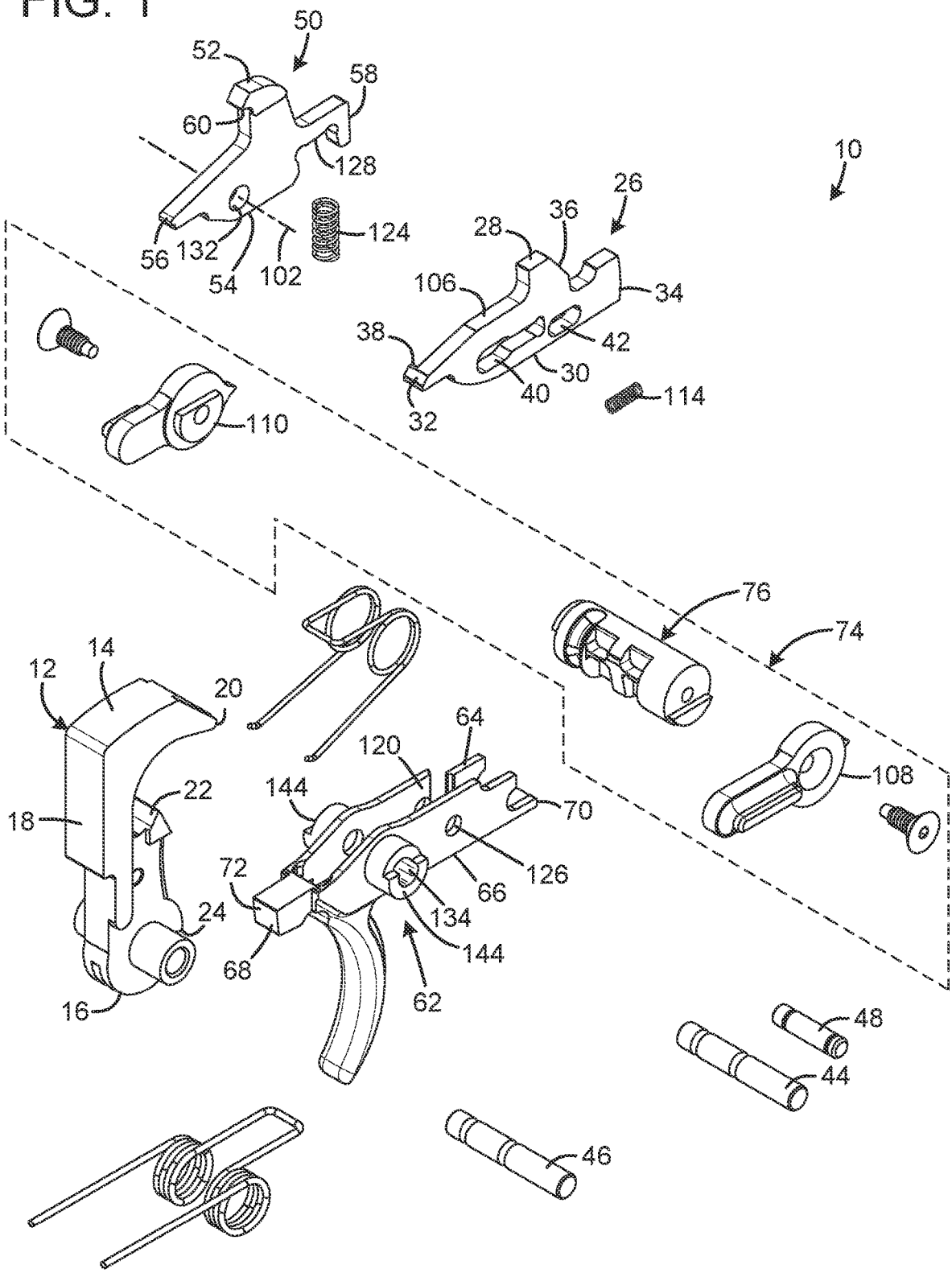
FIG. 1 is an exploded view of the current embodiment of the trigger group for semi-automatic firearms constructed in accordance with the principles of the present invention.

An embodiment of the trigger group for semi-automatic firearms of the present invention is shown and generally designated by the reference numeral 10.

Figure 3:
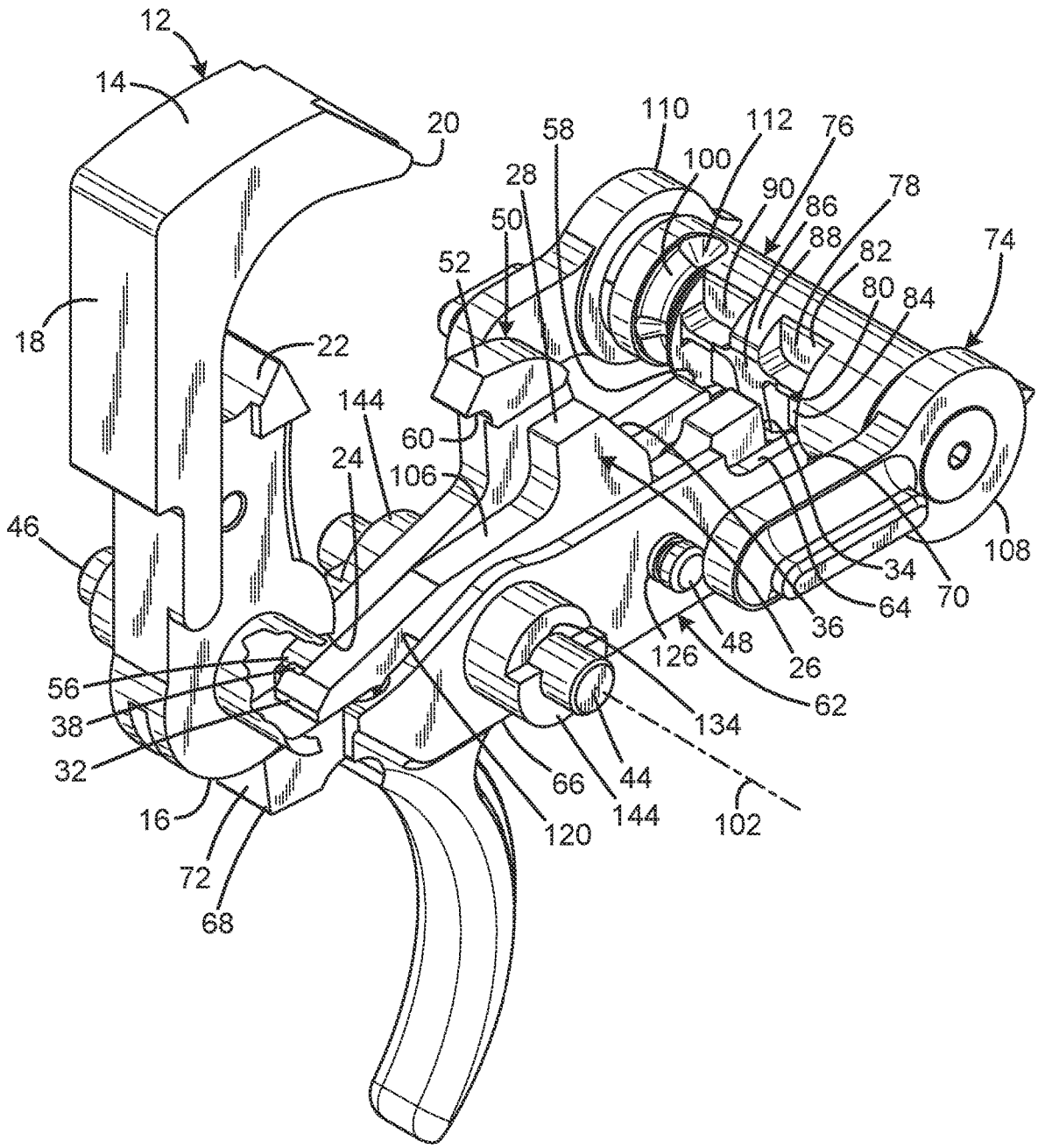
FIG. 3 is a front isometric view of the trigger group for semi-automatic firearms of FIG. 1 with the safety selector in binary mode.

FIGS. 1 and 3 illustrate the improved trigger group for semi-automatic firearms 10 of the present invention. More particularly, the trigger group for semi-automatic firearms 10 has a hammer 12, intermittent disconnector spacer 26, disconnector 50, trigger 62, and safety selector assembly 74. When assembled, the hammer, intermittent disconnector spacer, binary disconnector, disconnector, trigger, and safety selector are connected to a housing (not shown). Apertures in the housing receive cross-pins 44, 46. The cross-pins hold the trigger group for semi-automatic firearms 10 within the lower of the firearm (not shown). The cross-pins fit through apertures in the hammer, hammer spring (unlabeled), trigger, trigger spring (unlabeled), trigger spacers 144, and the housing. The trigger spacers are attached to the trigger, and keep the trigger from sliding laterally within the housing.

The hammer 12 has a top 14, bottom 16, front 18, and rear 20. The top rear of the hammer defines a curved notch 22 that is a disconnector 50 engagement surface, and the bottom rear of the hammer defines a hammer hook 24 that is for selective engagement of the sear 72. The hammer is moveable between a cocked position and striking position, with a spring driven bias toward the striking position, and includes a front striking face to impact the firing pin (not shown) of the host firearm (not shown). The top rear 20 of the hammer defines a cam lobe that extends from the top of the hammer in the direction of the bottom rear of the firearm and interacts with a rear ramp 36 on an intermittent disconnector spacer 26.

The intermittent disconnector spacer 26 is an elongated disconnector control element having a top 28, bottom 30, front 32, and rear 34. In addition to the rear ramp, the intermittent disconnector spacer includes a front wedge/block portion 38 extending out transversely from the left side 106 of the intermittent disconnector spacer toward the disconnector 50, a front slot 40, and a rear slot 42. The front wedge is positioned forward of a disconnector pivot axis 102. A pin 48 is received within apertures 126 in the trigger 62 and the rear slot. The intermittent disconnector spacer has a spring-driven bias from spring 114 toward the rear engaged/first control position and is oriented by the rail of the trigger 62, limited in linear travel toward the forward disengaged position by an end stop on the trigger, and limited in linear travel toward the engaged position by the safety selector assembly 74.

The rear 34 of the intermittent disconnector spacer 26 is radiused. The radiused rear can engage a selector shaft 76 of the safety selector assembly 74 at any angle as the intermittent disconnector spacer and trigger 62 rotate without causing the intermittent disconnector spacer to move longitudinally along the length of/relative to the trigger.

The front wedge 38 nestles between the trigger 62 and the disconnector 50 when the trigger is pulled far enough rearward to create a void between the disconnector forward nose end stop surface 56 and the trigger, thereby selectably intervening between a bottom 54 front contact portion of the disconnector and the trigger. The void alters the geometry of the hammer engagement surface/sear 72 of the trigger and the hammer engagement surface/forward-facing hammer retention hook 60 of the disconnector such that when the hammer 12 is released from the disconnector, the sear of the trigger will not be able to capture the hammer, thereby permitting the hammer to move to the striking position.

The rear ramp 36 on the intermittent disconnector spacer 26 is engaged by the hammer cam lobe 20 upon cocking of the hammer 12 such that if the trigger 62 is in a position that the hammer would not be captured by the trigger or disconnector 50 because of their modified geometry, or if the trigger were in any position forward of that, the intermittent disconnector spacer would be forced to its disengaged position, thereby moving the disconnector forward into position to capture the hammer to prevent hammer follow. Hammer follow could otherwise occur if the trigger were pulled far enough to fire, but not far enough for the sear to engage the hammer, while the disconnector was out of position to capture the hammer. In that circumstance, the hammer would cock when the bolt carrier group 148 cycled, but the trigger group for semi-automatic firearms 10 would have no device in position to capture the hammer, and the hammer would follow the bolt carrier group and firing pin (not shown) to the striking position, an effect commonly referred to as hammer follow and regarded as an automatic function of a firearm. Since the current invention is intended for use in a semi-automatic firearm, there must be no potential for hammer follow to occur. Because the intermittent disconnector spacer is automatically disengaged by normal function of the trigger group for semi-automatic firearms, there is no need for a secondary/backup disconnector to prevent hammer follow.

The disconnector 50 has a top 52, bottom 54, forward nose end 56, rear 58, and central aperture 132. The top of the disconnector includes a forward-facing hammer retention hook 60, and the bottom rear defines a notch 128. A disconnector spring 124 has one end received within the notch 128 in the bottom rear of the disconnector. The spring causes the disconnector to be biased to rotate clockwise towards the hammer 12 about pin 44 inserted through aperture 132 in the disconnector. The disconnector is moveable between an engaged position and a disengaged position, with a spring driven bias toward the engaged position. The position of the disconnector is associated directly with the position of the trigger 62, such that when the trigger is pulled far enough rearward, the disconnector is oriented in the engaged position, and when the trigger is far enough forward, the disconnector is oriented in the disengaged position. When the disconnector is in the engaged position, the hammer can move the disconnector in the direction counter its spring bias without affecting the position of the trigger. The forward-facing hook is a hammer engagement facility. The disconnector is also attached to the trigger, includes a front end stop surface that interacts with the trigger, and functions to capture the hammer when the trigger is no longer in a position to retain the hammer.

The trigger 62 has a top 64, bottom 66, front 68, rear 70, and central apertures 134. The top of the front of the trigger includes a sear 72. The intermittent disconnector spacer 26 and disconnector 50 are each planar bodies parallel to and adjacent to each other that fit in a channel 120 along the top spine of the trigger 62. In the current embodiment, the safety selector assembly 74 has a selector shaft 76 and is ambidextrous, with the lever on the left 108 being larger than the lever on the right 110. The safety selector is swappable, which enables the user to place the larger lever on the desired side of the firearm. The disconnector and sear both act as retention facilities each operable to selectively restrain the hammer in the cocked position. The trigger group for semi-automatic firearms 10 is suitable for use with an AR-15 rifle in the current embodiment.

FIGS. 2-2D illustrate the improved safety selector assembly 74 of the present invention. More particularly, the safety selector assembly provides the user of an associated firearm with three distinct modes: safe mode, semi-automatic mode, and binary mode. The safety selector has three cam lobe profiles 78, 86, 90 and a safety detent trough 100 extending from left 108 to right 110. Cam lobe 78 regulates the movement of the intermittent disconnector spacer 26. Cam lobe 86 regulates the movement of the trigger 62. Cam lobe 90 is present merely to facilitate machining of the safety selector assembly; at no point does the disconnector 50 contact the safety selector assembly.

The intermittent disconnector spacer cam 78 has a semi-circular profile at the section that engages the intermittent disconnector spacer 26 with two sections 82, 84 separated by a peak 80 of the cam lobe that allow the intermittent disconnector spacer 26 to move into the rearward engaged position when the safety selector assembly 74 is in binary mode, and prohibit the intermittent disconnector spacer from moving into the rearward engaged position when the safety selector assembly is in either semi-automatic mode or safe mode. The trigger relief and safety cam 86 has a full diameter section 88 that limits trigger 62 travel to distances unique to each mode position to prevent firing in safe mode and a trigger relief cut 86 to enable firing.

To facilitate engagement of the intermittent disconnector spacer 26, the trigger 62 is intentionally allowed to continue being pulled even once the disconnector 50 has reached a state of maximum forward rotation by colliding with the hammer 12. If the hammer is caught on the disconnector, and the user pulls the trigger further, at about 6° of rotation the disconnector will no longer rotate forward because the hammer blocks the disconnector from doing so. However, the trigger is allowed to continue rotating another 3-4°. This creates a gap between the front 56 nose of the disconnector and the top-front 64, 68 of the trigger. When that gap is created, the spring bias of the intermittent disconnector spacer pushes the intermittent disconnector rearward (when rearward movement is allowed by the selector assembly 74) into the engaged position.

The safety detent trough 100 located on the far right side 110 of the safety selector is a shallow groove with three plunge cuts 112 spaced 90° apart. A spring-loaded safety detent (not shown) has a tip that travels in this groove and stops at each plunge cut. This feature defines the three separate modes noted above. When additional finger pressure is applied to the safety selector lever, the safety detent spring is overridden, and the safety selector travels to the next plunge cut that defines the next mode.

Figure 4:
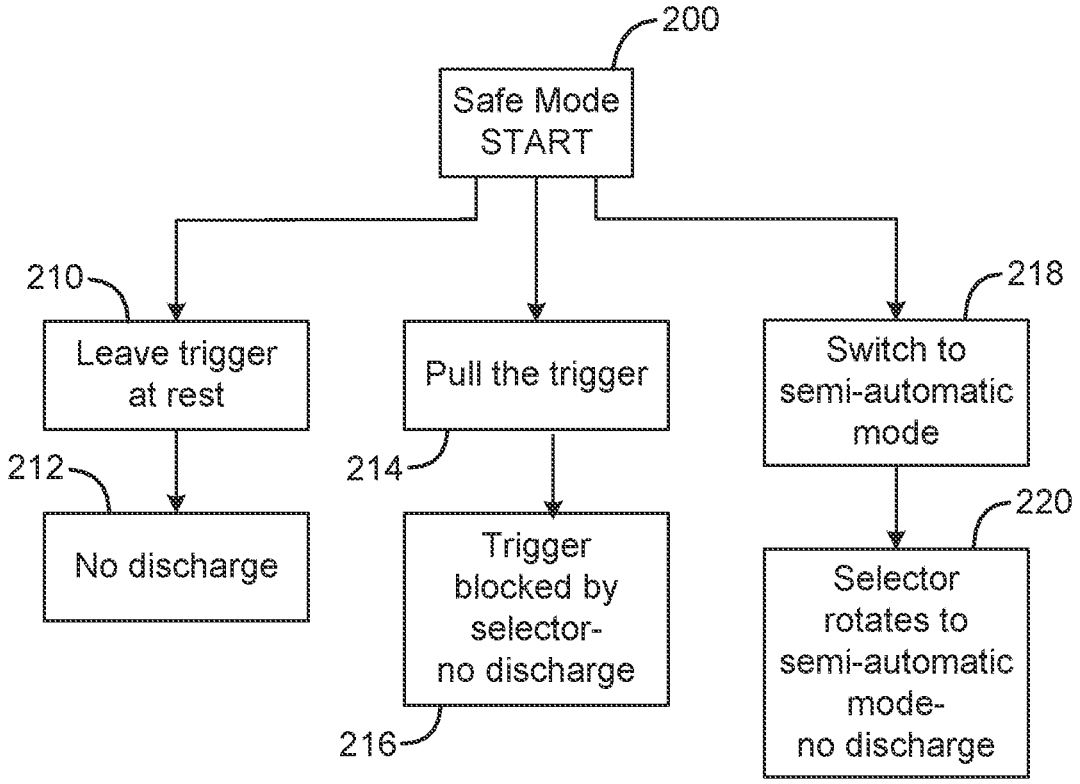
FIG. 4 is a flowchart detailing safe mode operation of the trigger group for semi-automatic firearms of FIG. 1.

FIG. 4 is a flowchart detailing safe mode operation of the trigger group for semi-automatic firearms 10. More particularly, at the start (200) of safe mode, the user has the option to leave the trigger 62 at rest (210), pull the trigger (214), or switch to semi-automatic mode (218). Leaving the trigger at rest results in no discharge (212), which is the condition illustrated in FIG. 5. Pulling the trigger in safe mode also results in no discharge (216) because the rear 70 of the trigger 62 is blocked by the cam lobe 78 (also shown in FIG. 5). Switching to semi-automatic mode results in the selector 74 rotating to semi-automatic mode (220) without a discharge, which is the condition shown in FIG. 7.

Figure 5:
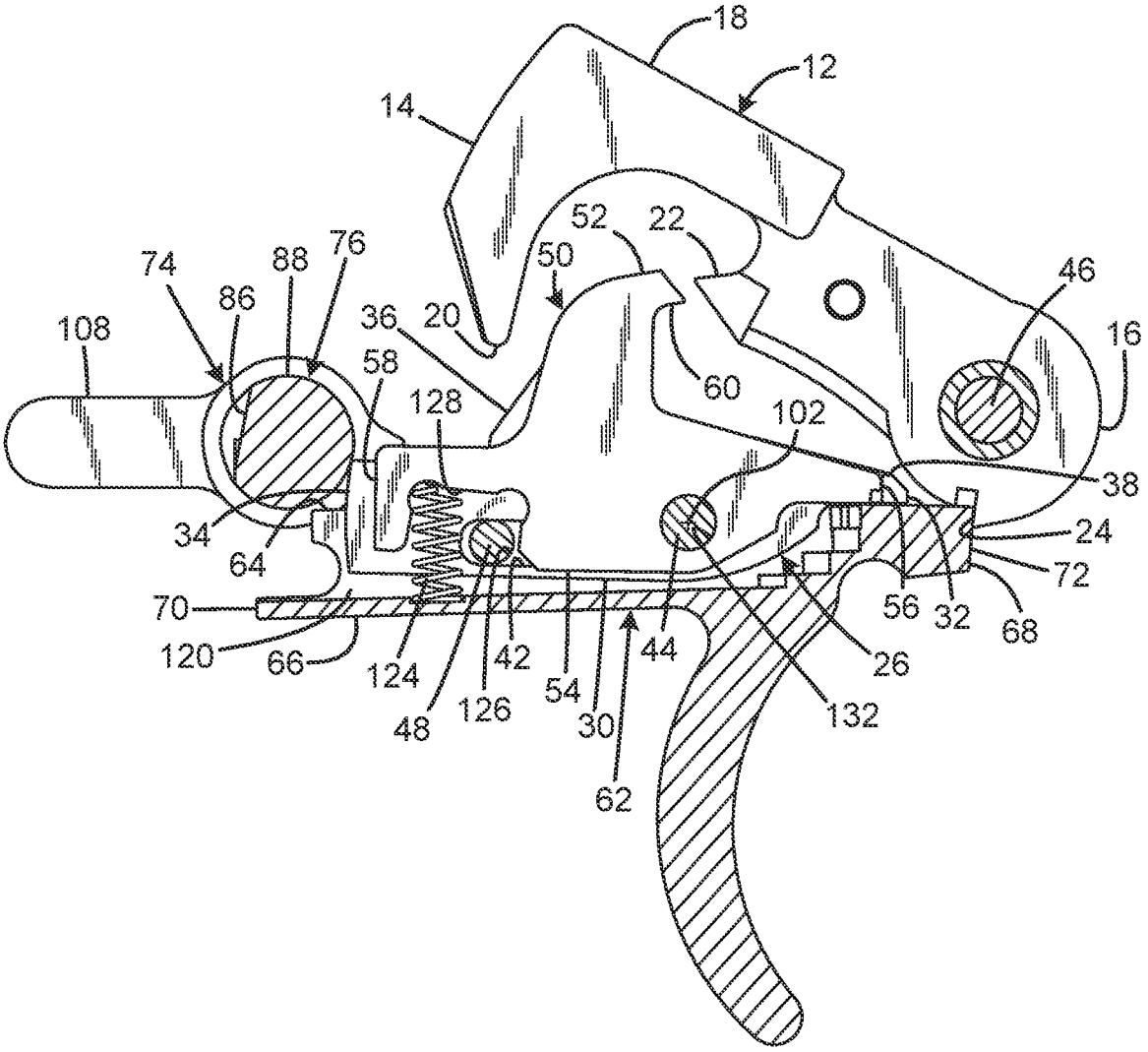
FIG. 5 is a right side sectional view of the trigger group for semi-automatic firearms of FIG. 1 with the safety selector in safe mode, the hammer cocked, and the trigger at rest.

FIG. 5 illustrates the improved trigger group for semi-automatic firearms 10 of the present invention. More particularly, the trigger group for semi-automatic firearms 10 is shown in safe mode with the safety selector assembly 74 pointing at the 3 o'clock position. The trigger is physically prevented from being pulled because cam lobe 86 on the safety selector assembly 74 is restricting the rearward section 70 of the trigger from moving upward. Since the trigger is immobilized, the hammer 12 is restricted from rotating forward under spring pressure because the sear 72 on the front 68 edge of the trigger is caught on notch 24 of the hammer. In addition, cam lobe 78 on the safety selector restricts the rear 34 of the intermittent disconnector spacer 26 from moving rearward into the rearward engaged position.

Figure 6:
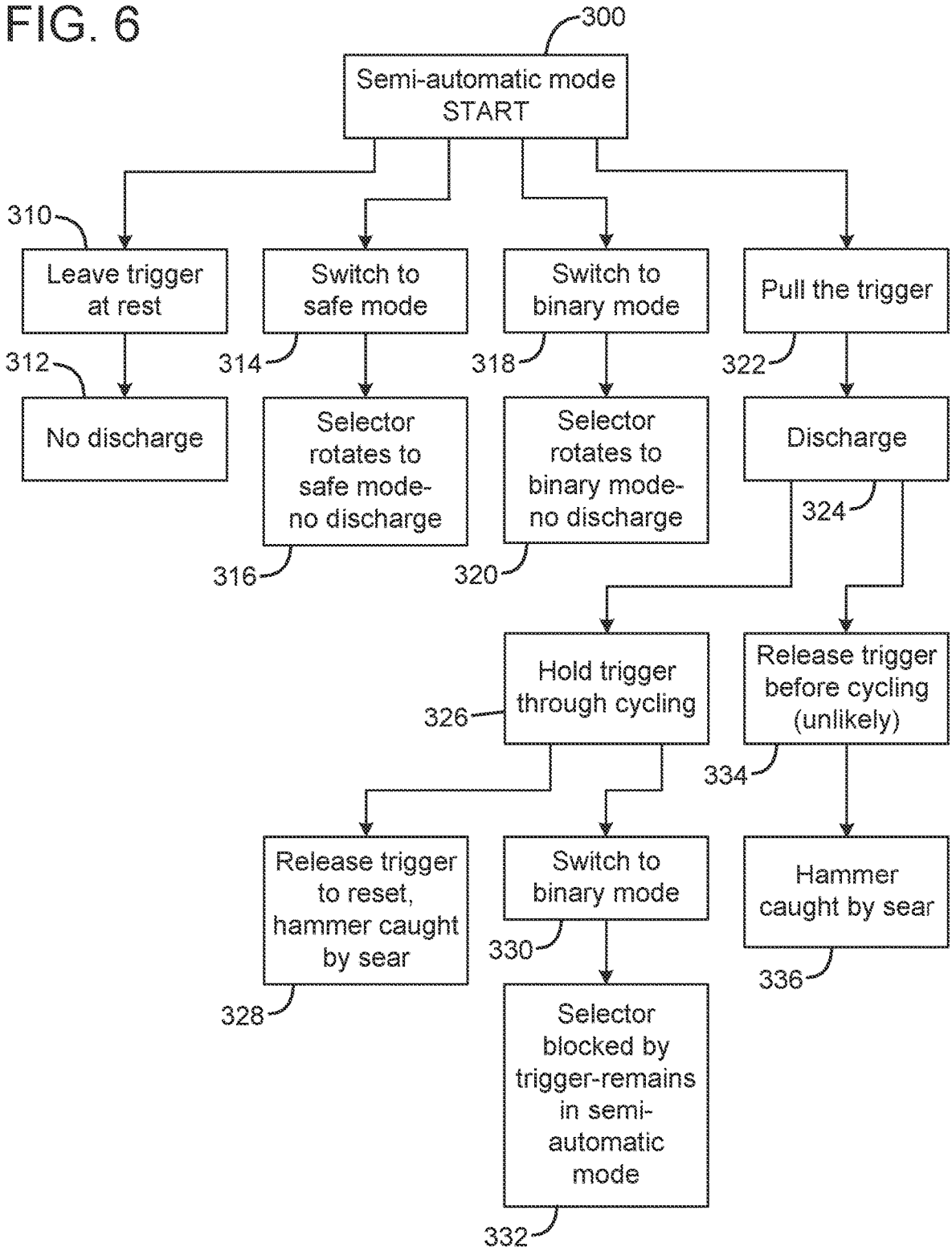
FIG. 6 is a flowchart detailing semi-automatic mode operation of the trigger group for semi-automatic firearms of FIG. 1.
Figure 10:
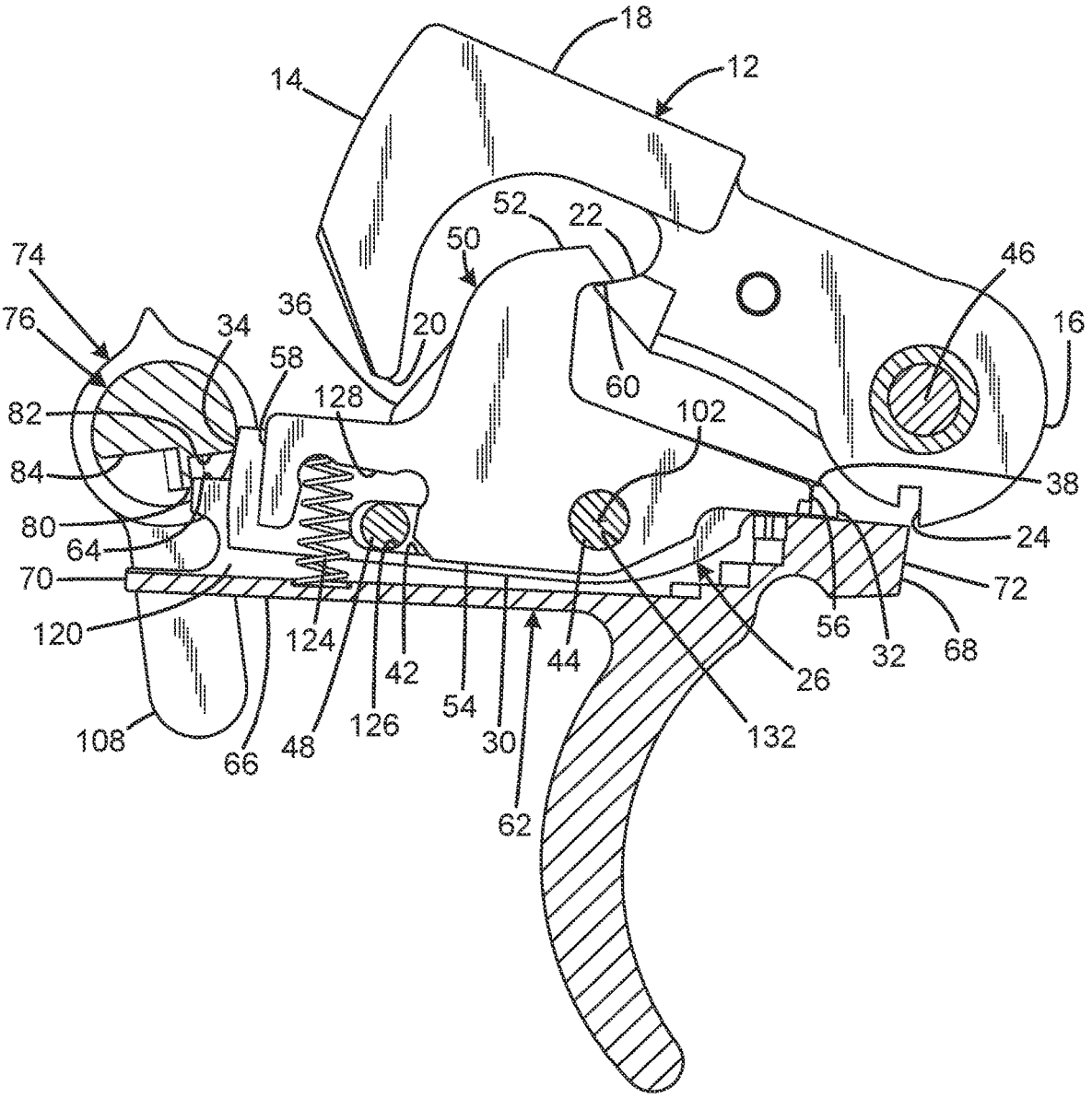
FIG. 10 is a right side sectional view of the trigger group for semi-automatic firearms of FIG. 1 with the safety selector prevented from transitioning from semi-automatic mode to binary mode when the trigger is pulled back sufficiently that otherwise an unintended shot would occur upon transition to binary mode.

FIG. 6 is a flowchart detailing semi-automatic mode operation of the trigger group for semiautomatic firearms 10. More particularly, at the start (300) of semi-automatic mode, the user has the option to leave the trigger 62 at rest (310), switch to safe mode (314), switch to binary mode (318), or pull the trigger (322). Leaving the trigger at rest results in no discharge (312), which is the condition illustrated in FIG. 7. Switching to safe mode results in the selector 74 rotating to safe mode (316) without a discharge, which is the condition shown in FIG. 4. Switching to binary mode results in the selector rotating to binary mode (318) without a discharge, which is the condition shown in FIG. 12. Pulling the trigger results in a discharge (324). After the trigger is pulled to the moment of hammer release (shown in FIG. 8), the user has the choice to hold the trigger through cycling (326) or to release the trigger before cycling (334). Upon choosing to hold the trigger through cycling, the user has the choice to release the trigger to reset the trigger group for semi-automatic firearms 10 with the hammer 12 caught by the sear 72 (328) shown in FIG. 7, or to attempt to switch to binary mode (330). An attempt to switch to binary mode with the trigger pulled back is unsuccessful because the disconnector 50 blocks the selector from rotating (332) as shown in FIG. 10, leaving the trigger group for semi-automatic firearms 10 in semi-automatic mode. In the unlikely event the user releases the trigger before cycling, the trigger group for semi-automatic firearms 10 resets with the hammer caught by the sear.

Figure 7:
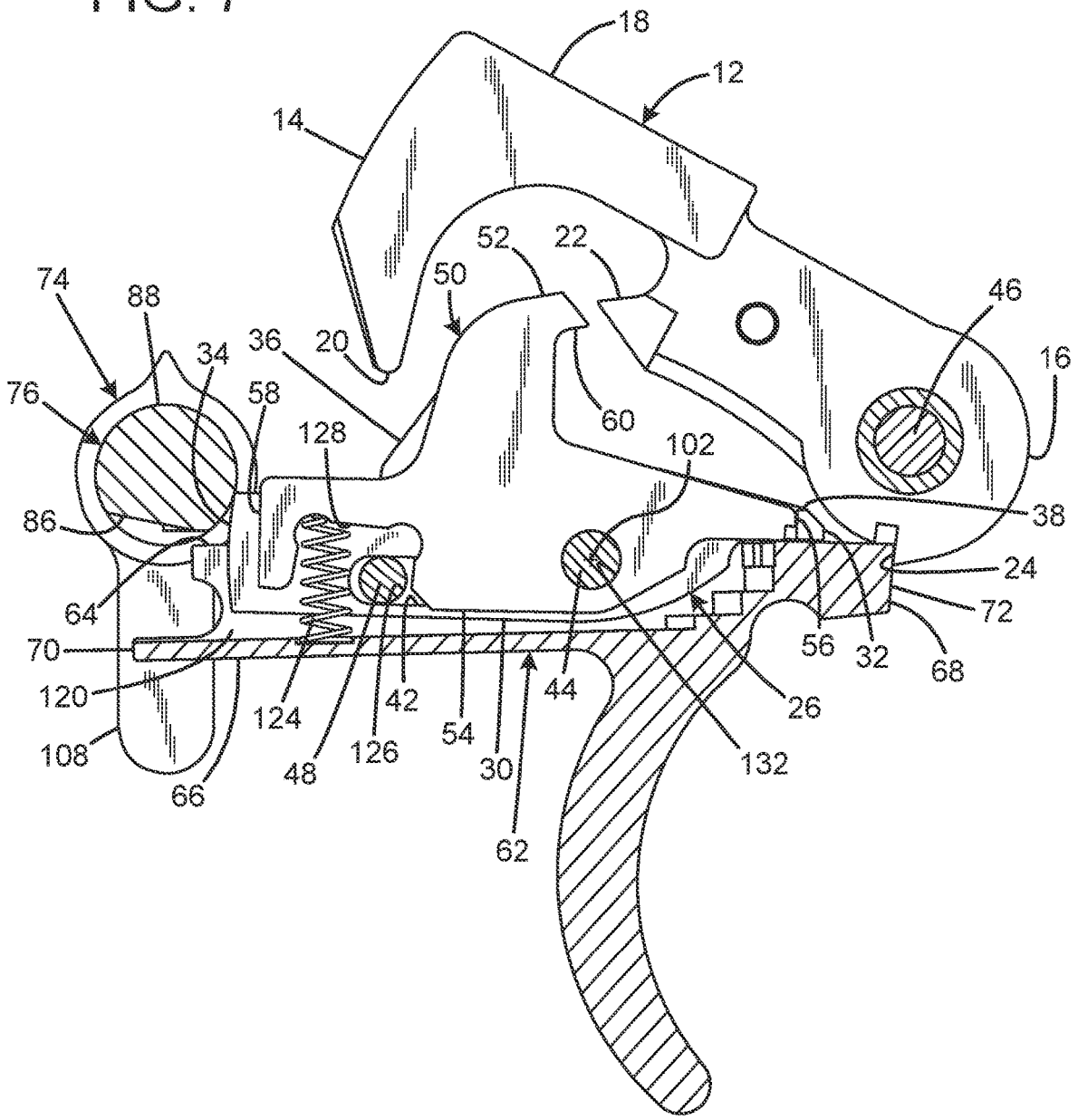
FIG. 7 is a right side sectional view of the trigger group for semi-automatic firearms of FIG. 1 with the safety selector in semi-automatic mode, the hammer cocked, and the trigger at rest.

FIG. 7 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. In this mode, cam lobe 86 on the safety selector assembly 74 is recessed to allow the trigger 62 to be pulled when the hammer 12 is cocked. Cam lobe 78 on the safety selector restricts the rear 34 of the intermittent disconnector spacer 26 from moving rearward into the engaged position. If the trigger is pulled in this mode, the hammer will rotate forward under spring pressure and hit the firing pin (not shown) to discharge a round.

Figure 8:
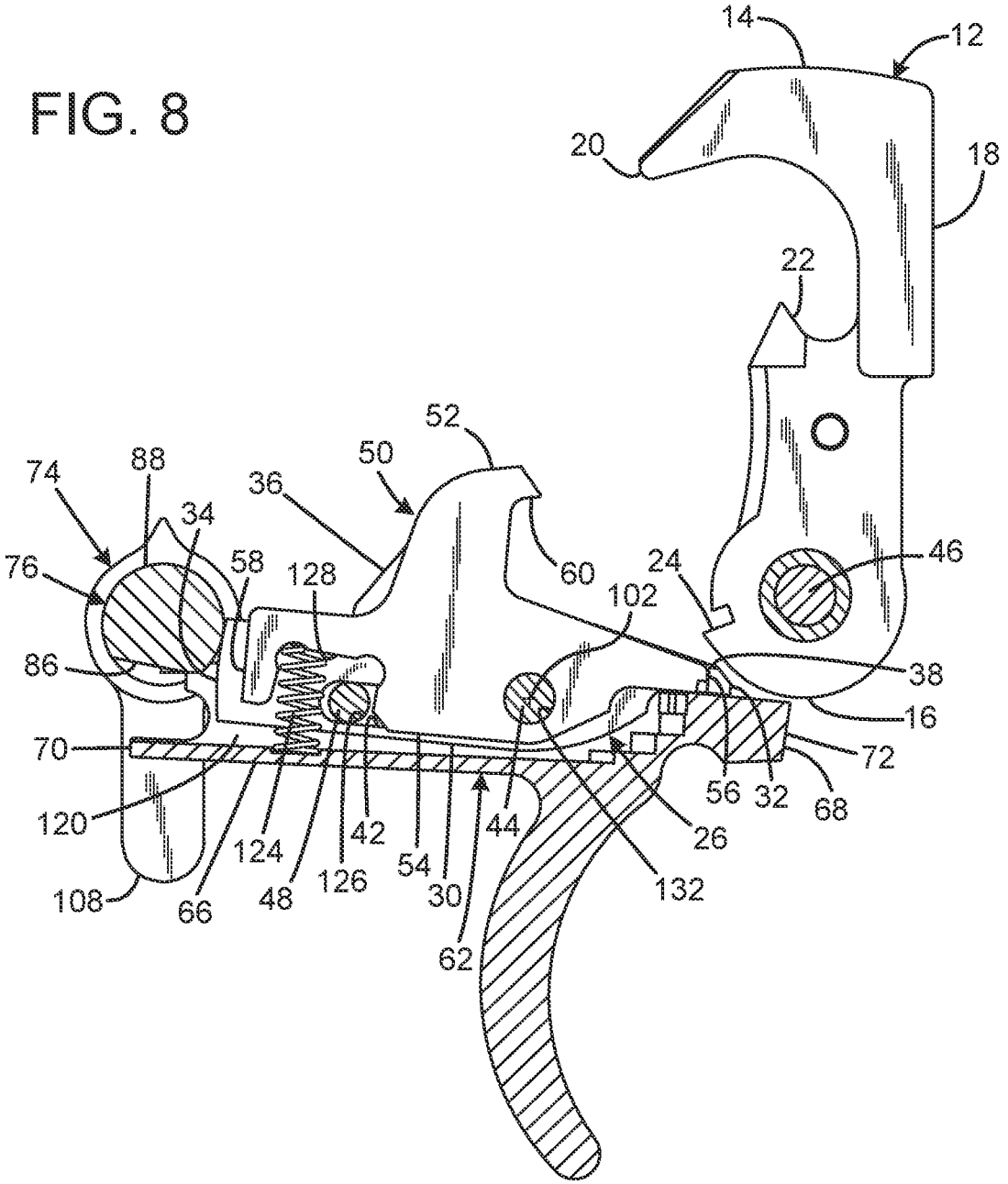
FIG. 8 is a right side sectional view of the trigger group for semi-automatic firearms of FIG. 1 at the moment of firearm discharge with the safety selector in semi-automatic mode and the trigger pulled to the moment of hammer release.

FIG. 8 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. The trigger 62 has been pulled rearward to the moment of hammer 12 release, which has disengaged the sear 72 from the notch 24 on the hammer. The disengagement has enabled the hammer to rotate forward under spring pressure to hit the firing pin to discharge a round.

Figure 9:
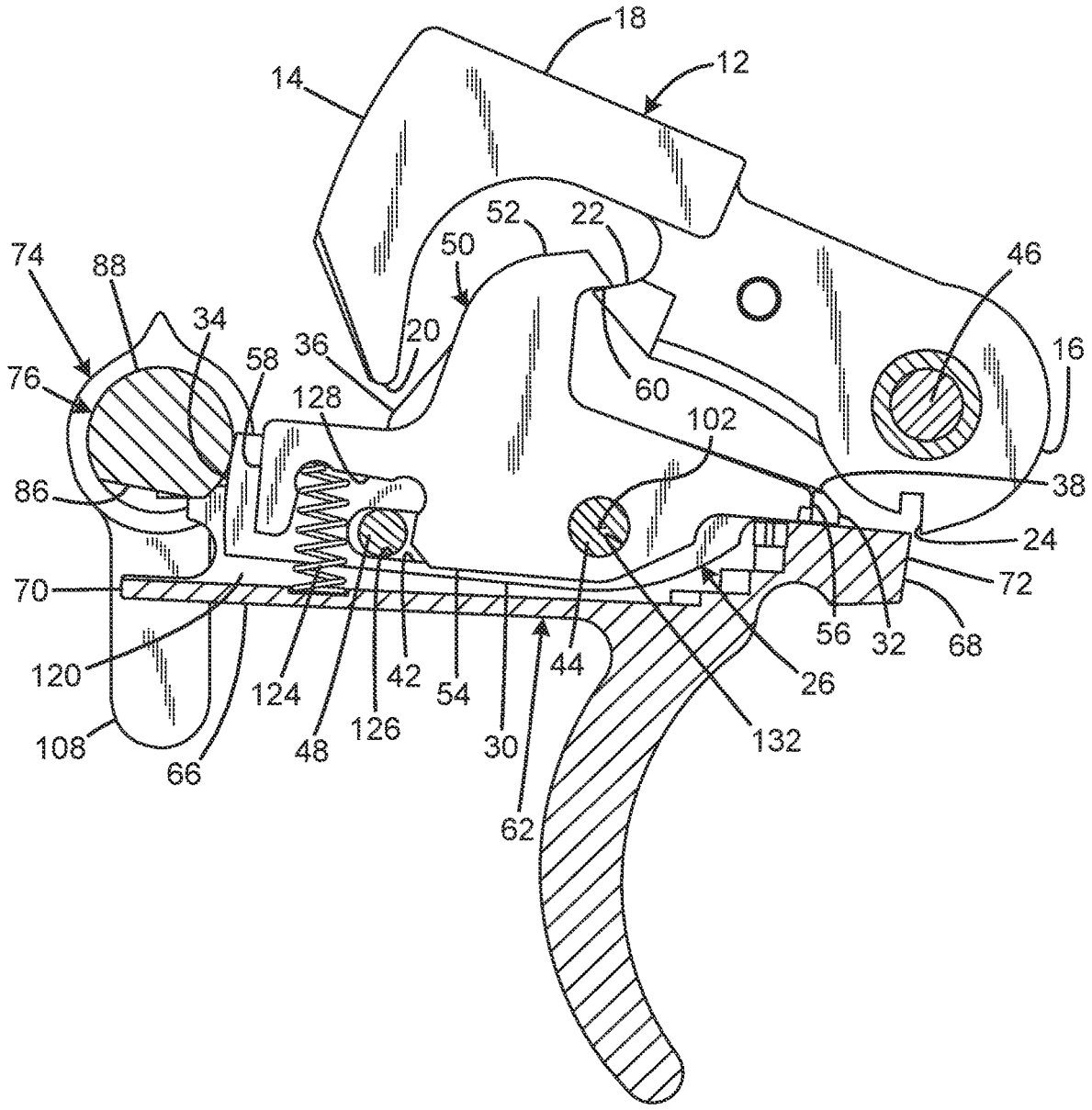
FIG. 9 is a right side sectional view of the trigger group for semi-automatic firearms of FIG. 1 after the firearm has been re-cocked with the trigger pulled when the safety selector is in semi-automatic mode.

FIG. 9 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. Gas pressure resulting from the discharge of a round has driven the bolt carrier group 148 (shown in FIG. 14) rearward, pushing the hammer 12 back into the cocked position. The notch 22 of the hammer has latched onto the hook 60 of the disconnector 50. This engagement prevents the hammer from rotating forward again even though the trigger 62 remains pulled. As the trigger is released, the front 56 of the disconnector is pushed up. This movement disengages the notch 22 of the hammer from the hook 60 of the disconnector. Just prior to the hammer disengaging from the disconnector, the sear 72 on the trigger 62 is positioned to catch the notch 24 in the hammer, which prevents the hammer from rotating forward until the trigger is pulled again. This is the position shown in FIG. 7.

FIG. 10 illustrates the improved trigger group for semi-automatic firearms 10 of the present invention. More particularly, the trigger group for semi-automatic firearms 10 is shown failing to transition from semi-automatic mode to binary mode. The safety selector assembly 74 cannot transition from semi-automatic mode to binary mode unless the trigger 62 is forward. Otherwise, the rear 58 of the disconnector 50 blocks cam lobe 90 on the safety selector and prevents further counterclockwise rotation of the safety selector into binary mode. The intermittent disconnector spacer 26 is also blocked by cam lobe 78. This safety feature prevents users from inadvertently shifting the safety selector to binary mode unless the user clearly intends to do so. The position of the bolt carrier group 148 (shown in FIG. 14) does not affect the ability to transition from semi-automatic mode to binary mode.

In this condition, the rear 58 of the disconnector 50 is positioned downward in the path of the cam lobe 90 on the safety selector assembly 74. The user cannot rotate the safety selector counterclockwise into binary mode with the safety selector pointing at the 3 o'clock position when the trigger is pulled in semi-automatic mode.

Figure 11:
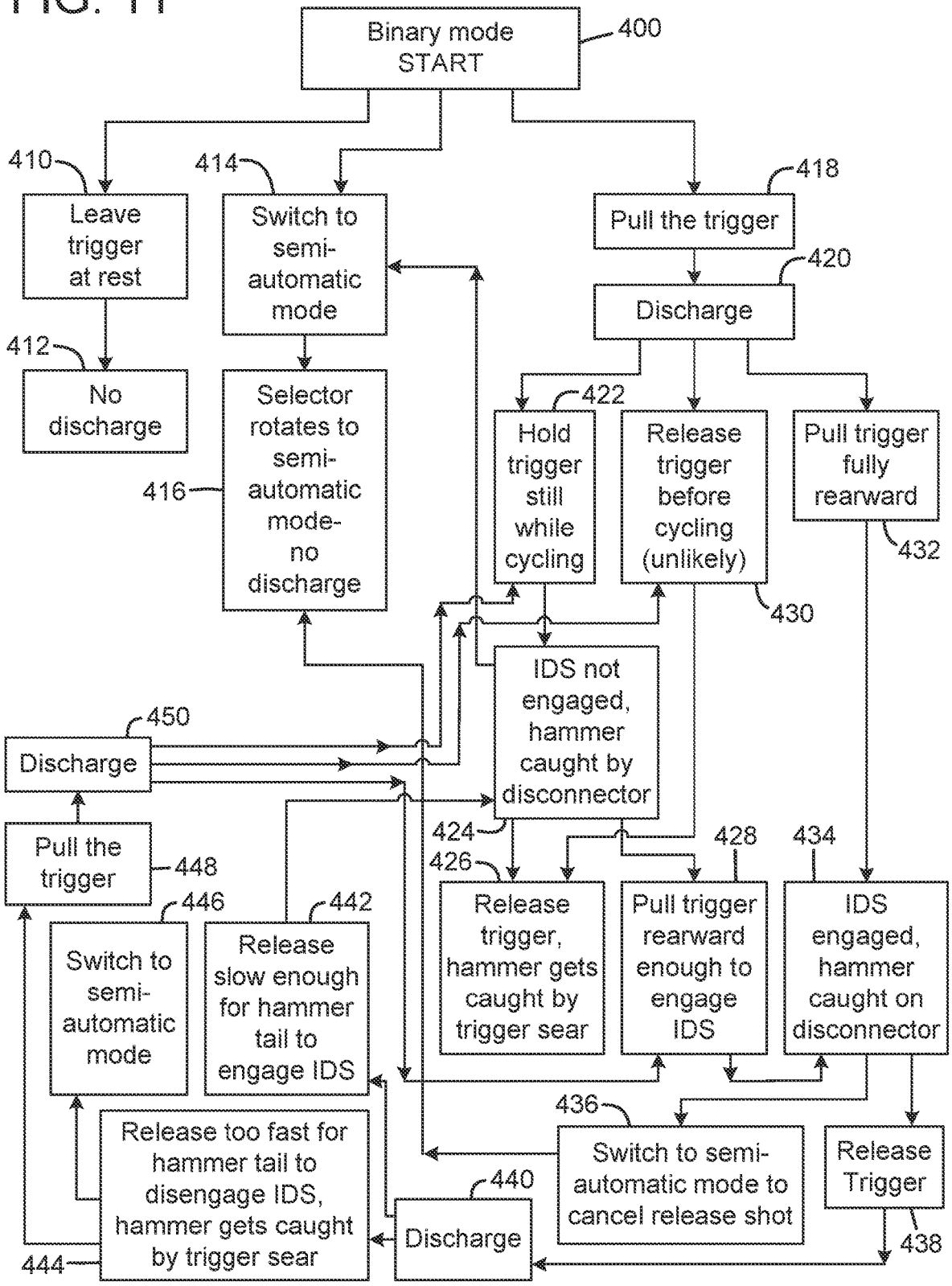
FIG. 11 is a flowchart detailing binary mode operation of the trigger group for semi-automatic firearms of FIG. 1.
Figure 12:
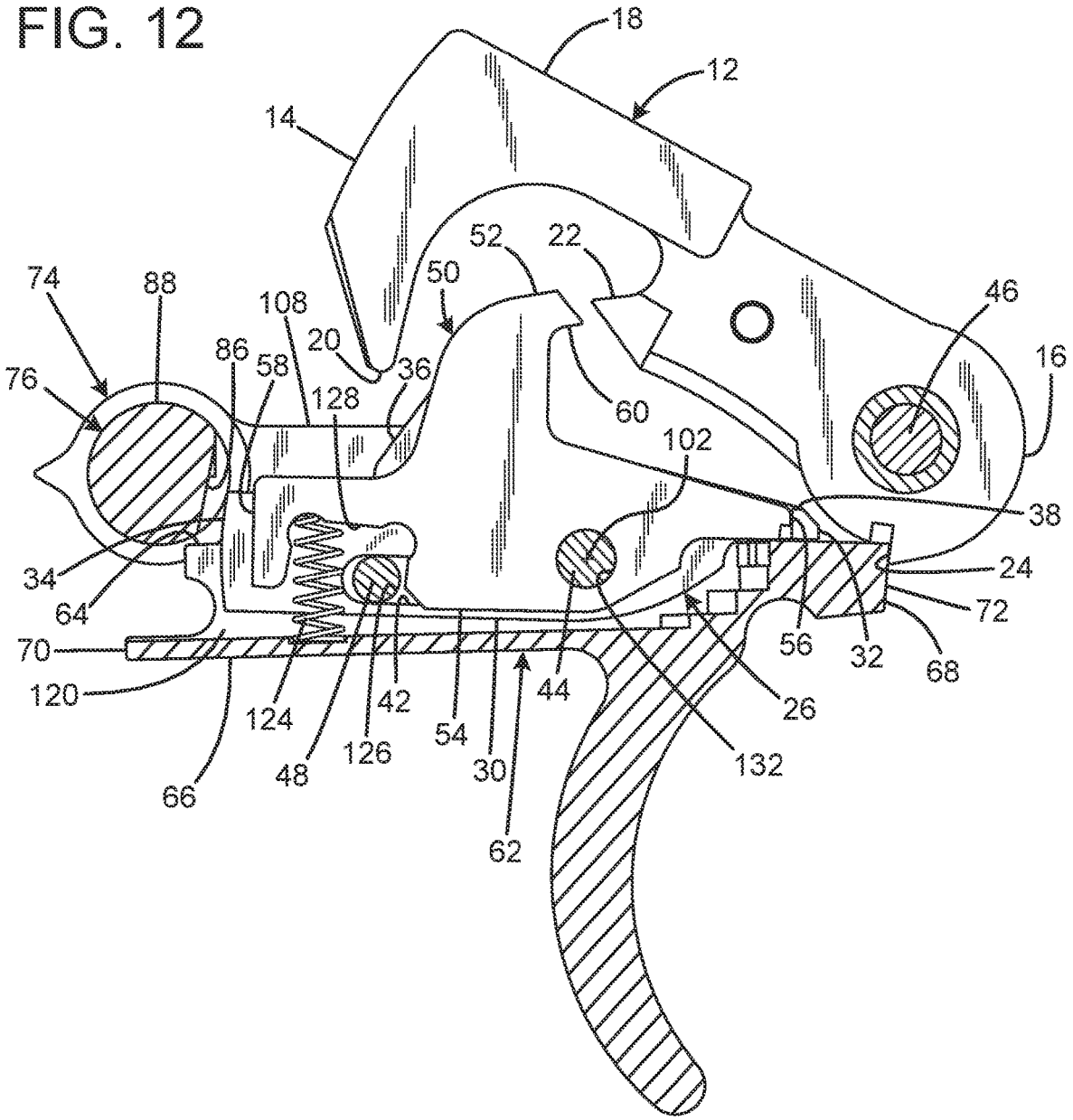
FIG. 12 is a right side sectional view of the trigger group for semi-automatic firearms of FIG. 1 with the safety selector in binary mode, the hammer cocked, and the trigger at rest.

FIG. 11 is a flowchart detailing binary mode operation of the trigger group for semi-automatic firearms 10. More particularly, at the start (400) of binary mode, the user has the option to leave the trigger 62 at rest (410), switch to semi-automatic mode (414), or pull the trigger (418). Leaving the trigger at rest results in no discharge (412), which is the condition illustrated in FIG. 12. Switching to semi-automatic mode results in the selector 74 rotating the semi-automatic mode (416) without a discharge, which is the condition shown in FIG. 7. Pulling the trigger results in a discharge (420) shown in FIG. 13. After the trigger is pulled to the moment of hammer release (shown in FIG. 13), the user has the choice to hold the trigger still while cycling (422), release the trigger before cycling (430), or pull the trigger fully rearward (432) to enable the intermittent disconnector spacer to become engaged (434). In the unlikely event the user releases the trigger before cycling, the hammer is caught by the sear 72 (426) as shown in FIG. 12.

Holding the trigger 62 still while cycling results in the intermittent disconnector spacer 26 not being engaged, and the hammer 12 being caught by the disconnector 50 as shown in FIG. 7. The user then has the option to switch to semi-automatic mode (414), release the trigger so the hammer is caught by the sear 72 (426), or pull the trigger rearward fully to enable the intermittent disconnector spacer to become engaged (434).

Figure 15:
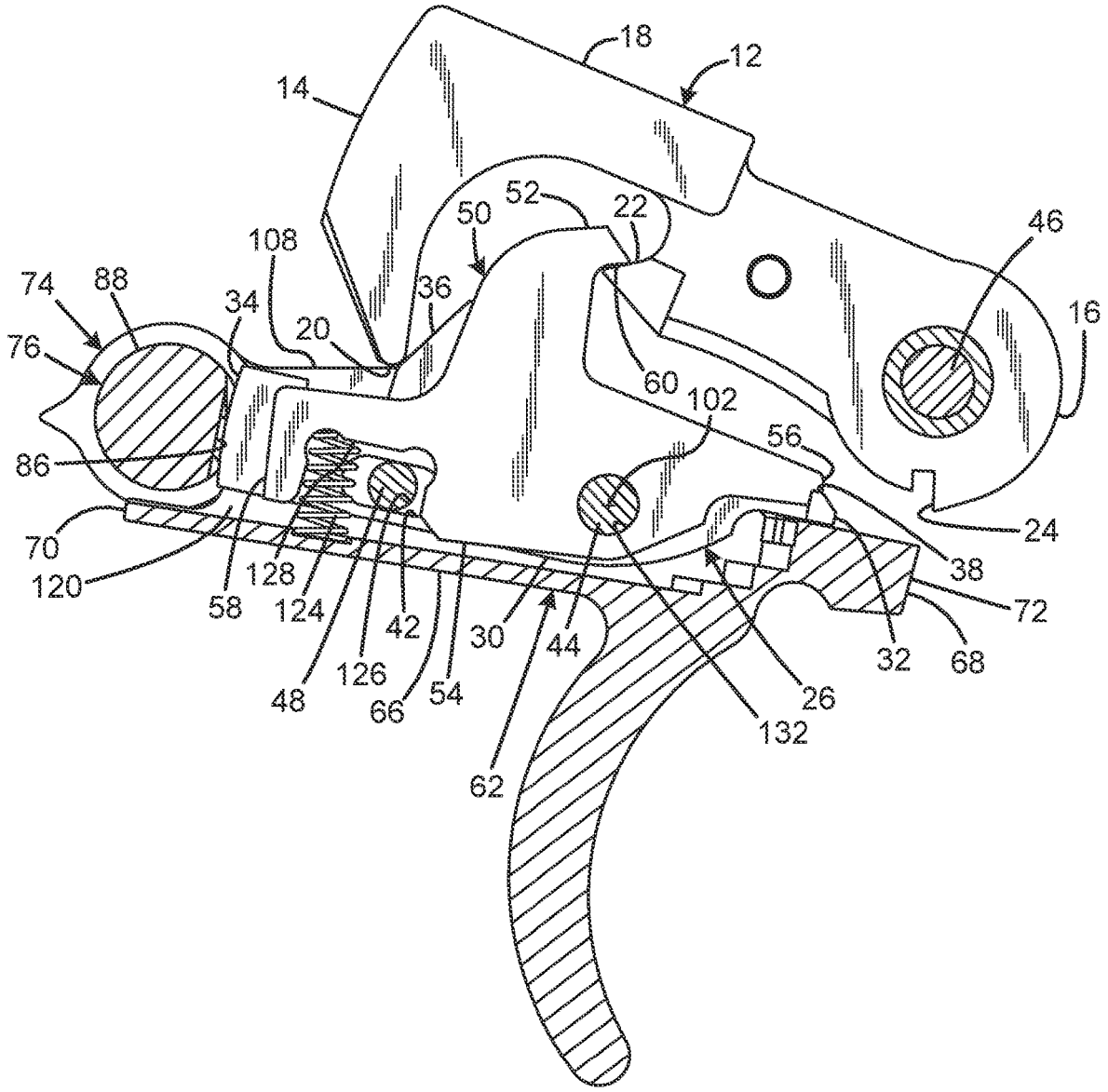
FIG. 15 is a right side sectional view of the trigger group for semi-automatic firearms of FIG. 1 with the safety selector in binary mode and the trigger pulled further than the moment of hammer release with the intermittent disconnector spacer engaged.
Figure 16:
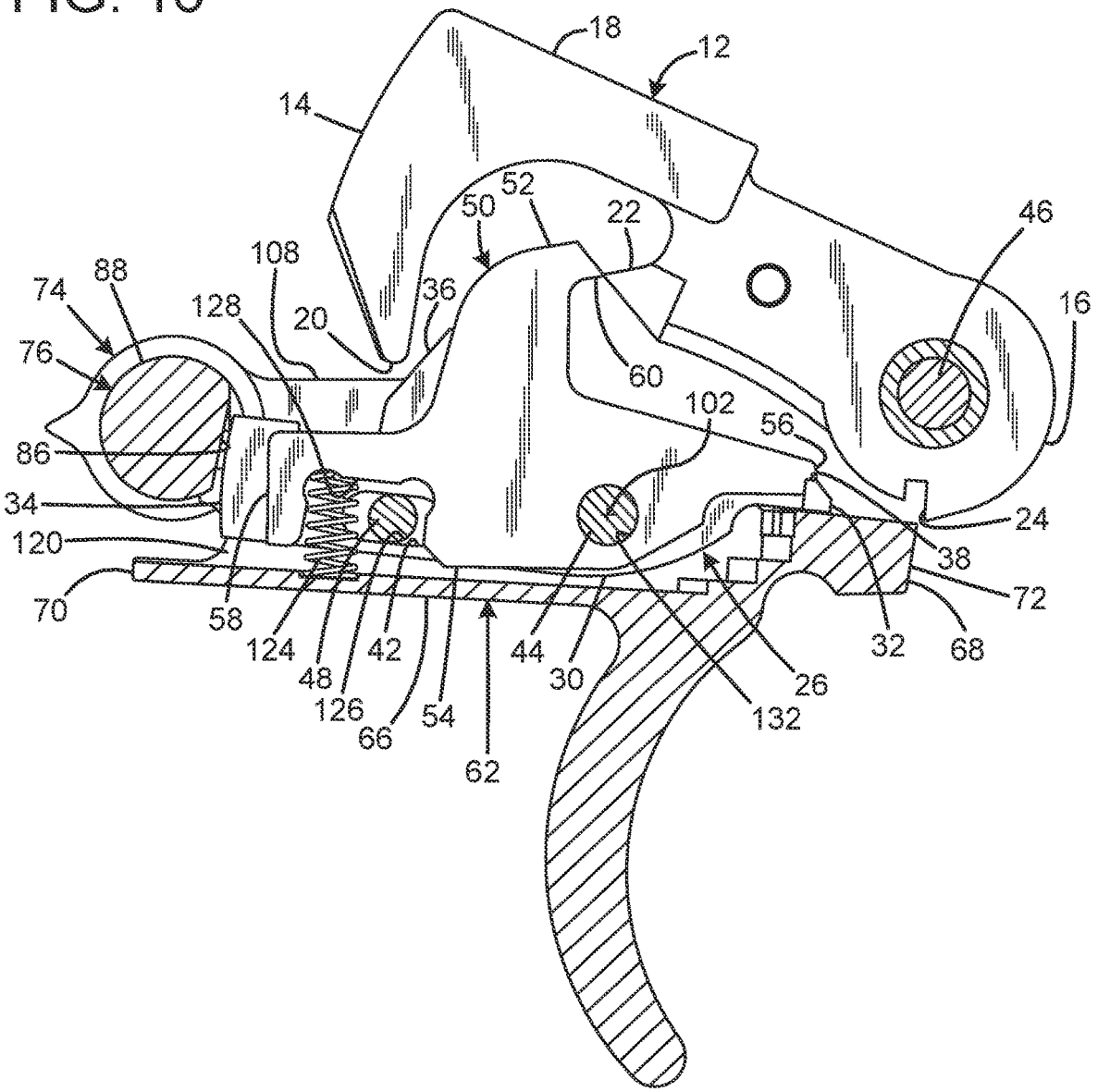
FIG. 16 is a right side sectional view of the trigger group for semi-automatic firearms of FIG. 1 with the safety selector in binary mode and the trigger relaxed sufficiently to disengage the hammer from the disconnector.
Figure 20:
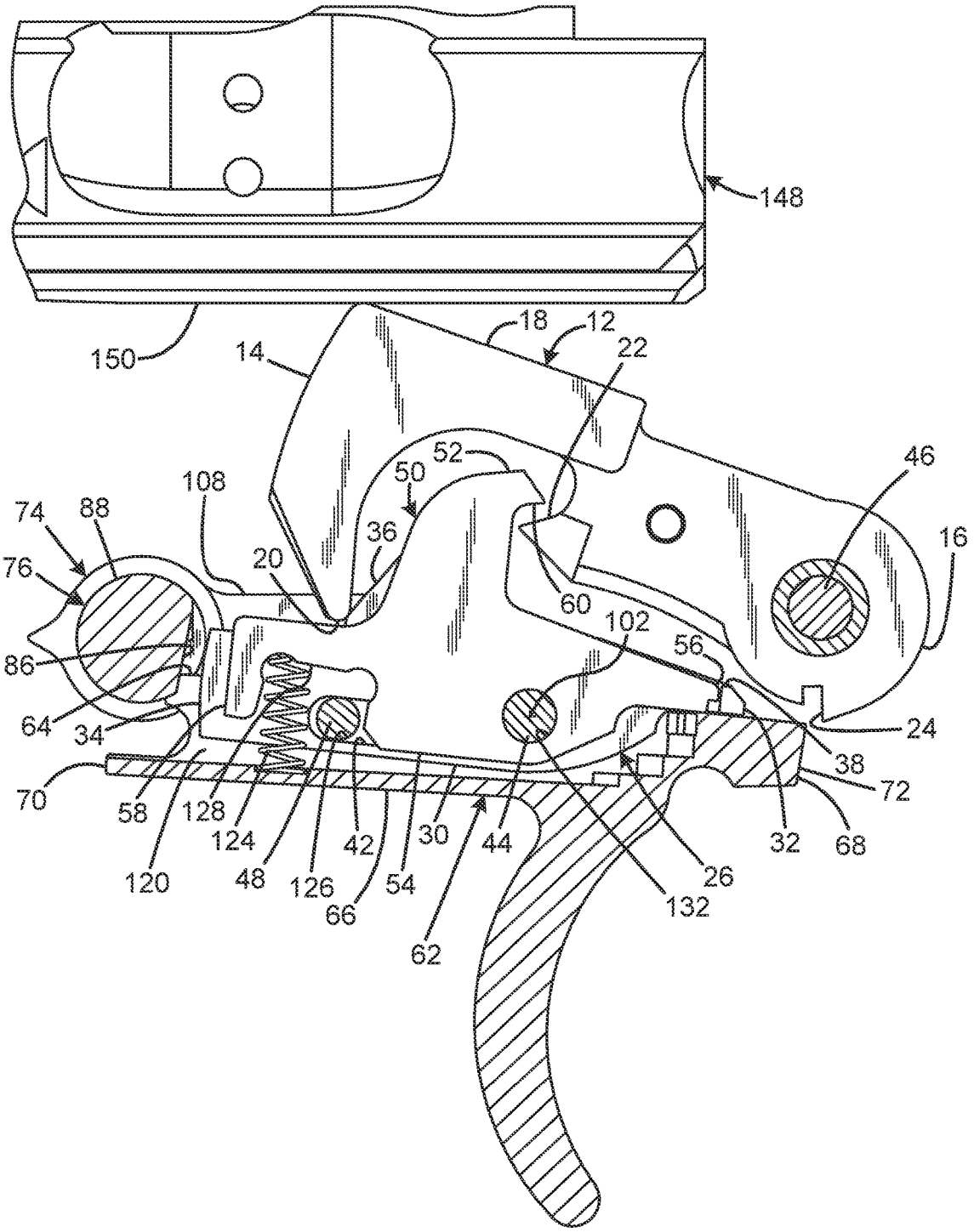
FIG. 20 is a right side sectional view of the trigger group for semi-automatic firearms of FIG. 1 with the safety selector in binary mode and the trigger having been released slowly enough that the hammer has forced the intermittent disconnector spacer out of engagement.
Figure 21:
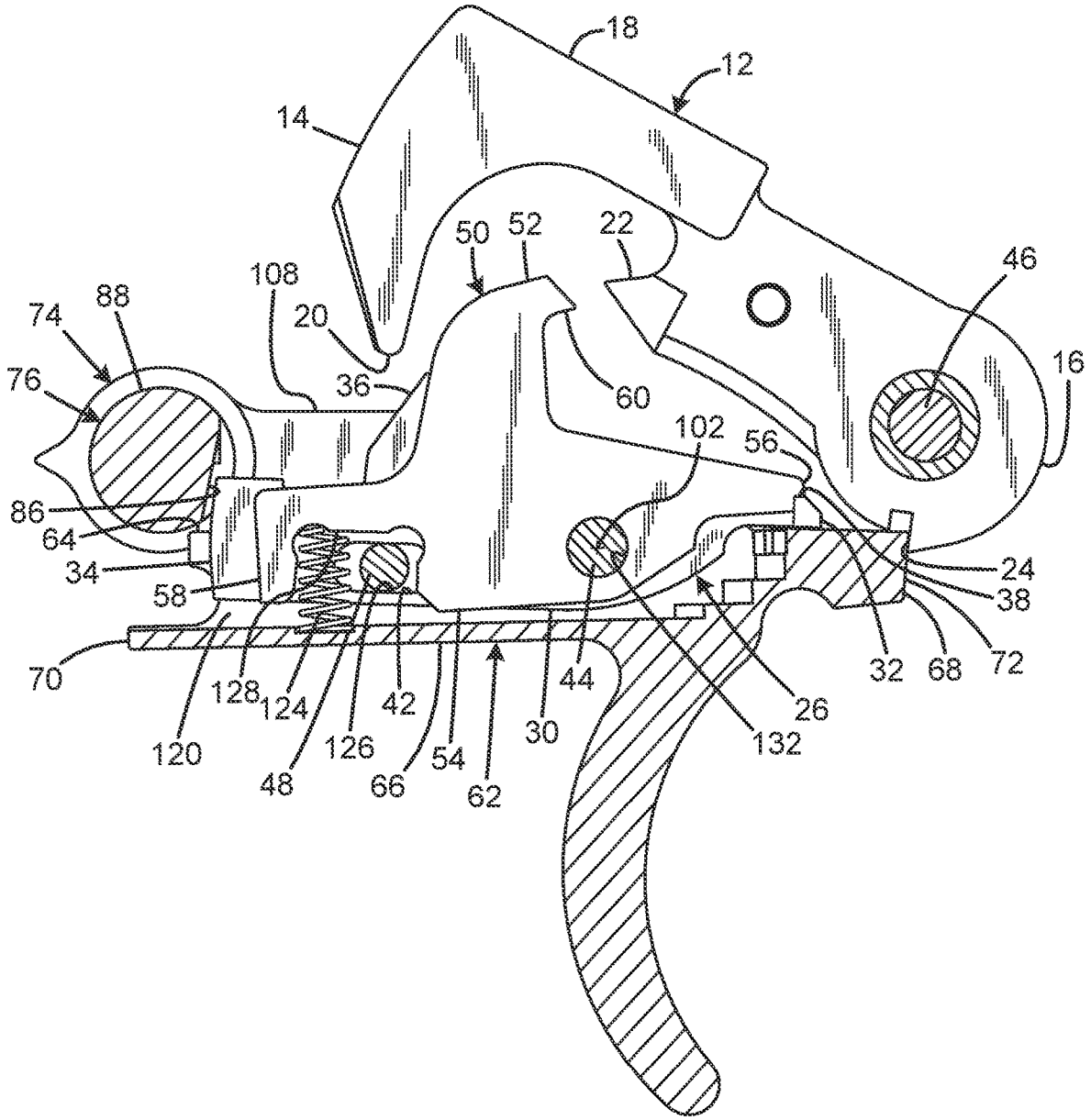
FIG. 21 is a right side sectional view of the trigger group for semi-automatic firearms of FIG. 1 with the safety selector in binary mode and the trigger having been released too quickly for the hammer to force the intermittent disconnector spacer out of engagement.

When the trigger group for semi-automatic firearms 10 achieves the condition where the intermittent disconnector spacer has become engaged (434) shown in FIG. 15, the user has the option to cancel the release shot by switching to semi-automatic mode (436), or to release the trigger (438) shown in FIG. 16. If the trigger is released, there is a discharge (440) shown in FIG. 17. The user then has the choice to release the trigger slowly enough for the rear 20 of the hammer 12 to disengage the intermittent disconnector spacer 26 (442) as shown in FIG. 20 and return to condition (424), or to release the trigger too quickly for the rear of the hammer to disengage the intermittent disconnector spacer (444) as shown in FIG. 21.

Figure 22:
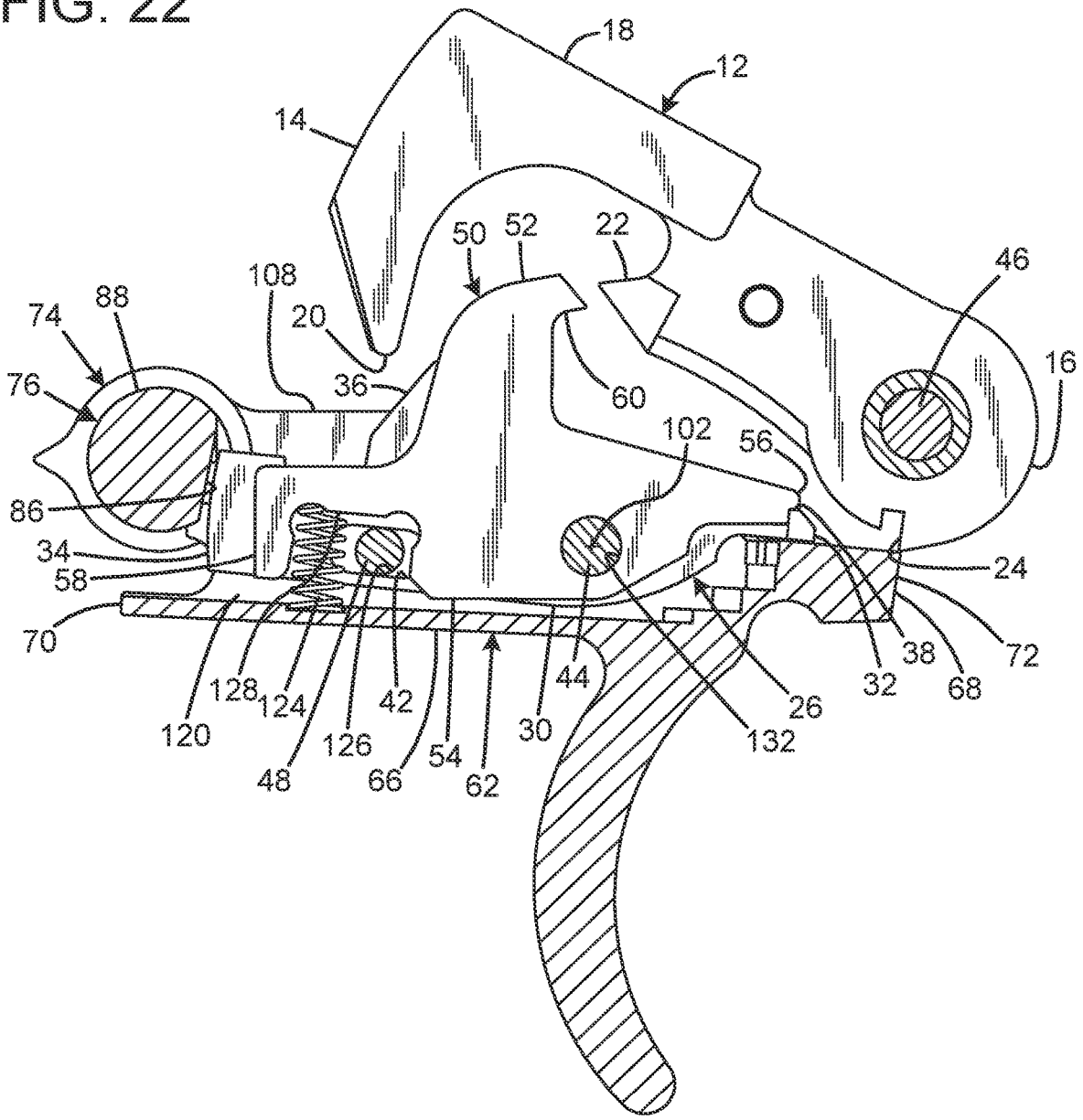
FIG. 22 is a right side sectional view of the trigger group for semi-automatic firearms of FIG. 1 with the safety selector in binary mode and the trigger pulled to the moment of hammer release.

When the trigger 62 is released too quickly for the intermittent disconnector spacer 26 to be disengaged, the hammer 12 is caught on the sear 72. The user then has the option to switch to semi-automatic mode (446), or pull the trigger (448). Pulling the trigger results in a discharge (450). The user then has the option as shown in FIG. 22 to pull the trigger fully rearward (428) to return to condition (434), release the trigger before cycling (430) (unlikely) to return to condition (426), or to hold the trigger still through cycling (422). Holding the trigger still through cycling results in the rear 20 of the hammer disengaging the intermittent disconnector spacer and a return to condition (424).

FIG. 12 illustrates the improved trigger group for semi-automatic firearms 10 of the present invention. More particularly, the trigger group for semi-automatic firearms 10 is shown in binary mode with the safety selector pointing at the 9 o'clock position. After a successful transition to binary mode with the trigger 62 forward, cam lobe 86 on the safety selector is recessed to allow the trigger 62 to be pulled when the hammer 12 is cocked. The hammer is restrained by the engagement of the sear 72 on the trigger with the notch 24 on the hammer. If the trigger is subsequently pulled, the hammer will rotate forward under spring pressure and hit the firing pin to discharge a round.

Figure 13:
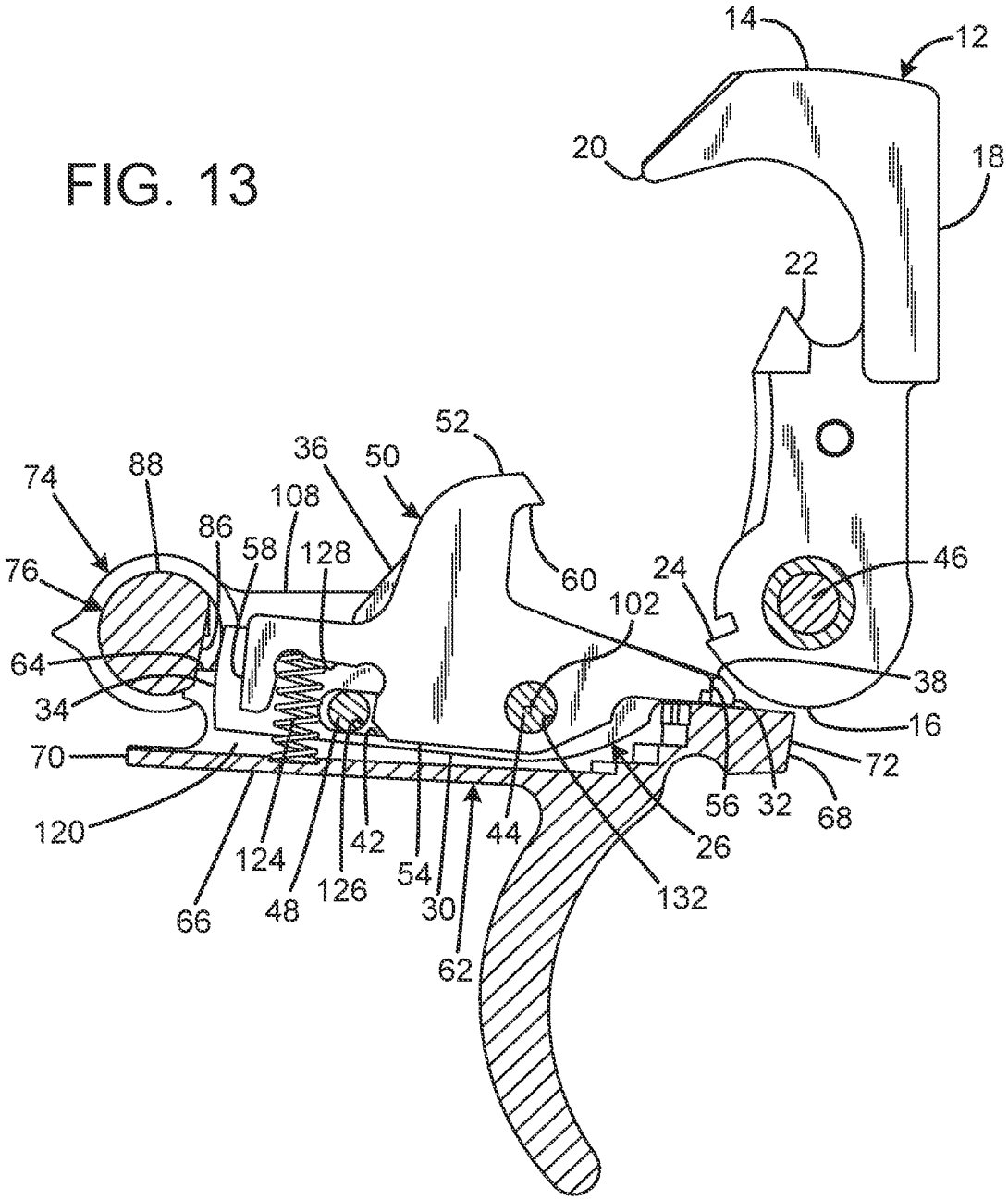
FIG. 13 is a right side sectional view of the trigger group for semi-automatic firearms of FIG. 1 at the moment of firearm discharge with the safety selector in binary mode and the trigger pulled to the moment of hammer release.

FIG. 13 illustrates the improved trigger group for semi-automatic firearms 10 of the present invention. More particularly, the trigger group for semi-automatic firearms 10 is shown in binary mode with the safety selector pointing at the 9 o'clock position. The trigger 62 has been pulled rearward to the moment of hammer 12 release, which has disengaged the sear 72 from the notch 24 on the hammer. The disengagement has enabled the hammer to rotate forward under spring pressure to hit the firing pin to discharge a round.

Figure 14:
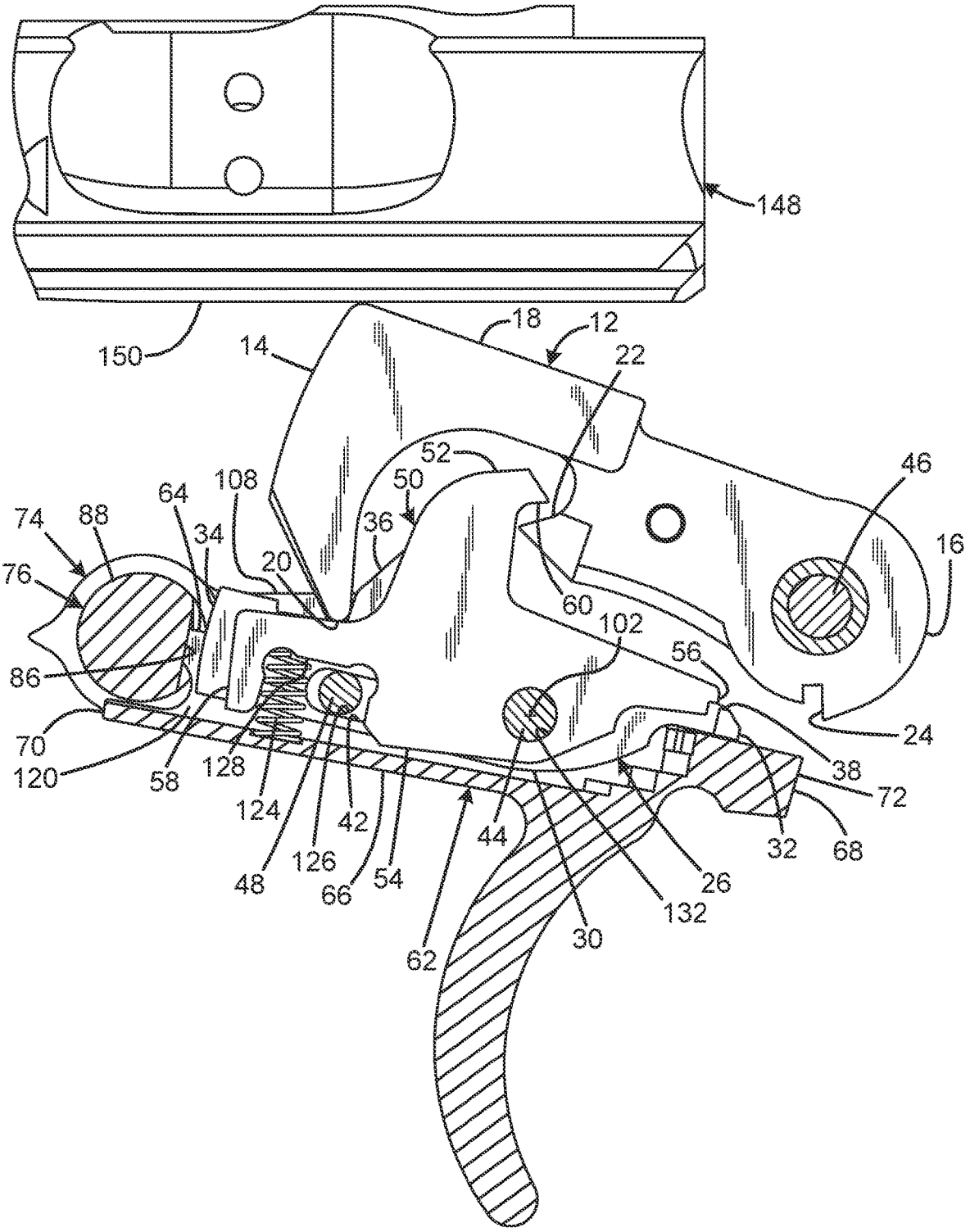
FIG. 14 is a right side sectional view of the trigger group for semi-automatic firearms of FIG. 1 with the safety selector in binary mode and the trigger pulled further than the moment of hammer release with the intermittent disconnector spacer held disengaged by the rear of the hammer.

FIG. 14 illustrates the improved trigger group for semi-automatic firearms 10 of the present invention. More particularly, the trigger group for semi-automatic firearms 10 is shown in binary mode with the safety selector pointing at the 9 o'clock position. In FIG. 14, the trigger 62 has been previously pulled, which disengaged the sear 72 from the notch 24 on the hammer 12. The disengagement enabled the hammer to rotate forward under spring pressure to hit the firing pin to discharge a round. Gas pressure resulting from the discharge of the round has driven the bolt carrier group 148 rearward. The bottom 150 of the bolt carrier group has depressed the top 14 of the hammer into a maximum compressed state. Depression means moving the hammer beyond the cocked position, further away from the firing position. The trigger 62 is positioned so the sear 72 on the trigger cannot catch the hammer 12 when the hammer falls forward after the bolt carrier group 148 releases the hammer when the bolt carrier group travels forward. The front 56 of the disconnector 50 has lifted sufficiently to permit the intermittent disconnector spacer 26 to slide rearward with the wedge 38 under the front of the disconnector. However, the intermittent disconnector space is prevented from moving rearward because the rear 20 of the hammer is pushing down on the rear ramp 36 of the intermittent disconnector spacer.

FIG. 15 illustrates the improved trigger group for semi-automatic firearms 10 of the present invention. More particularly, the trigger group for semi-automatic firearms 10 is shown in binary mode with the safety selector pointing at the 9 o'clock position. In FIG. 15, the trigger 62 is pulled back sufficiently far that when the hammer 12 is released by the bolt carrier group 148 when the bolt carrier group travels forward, the rear 20 of the hammer clears the rear ramp 36 of the intermittent disconnector spacer 26, which permits the intermittent disconnector spacer to slide rearward into the engaged position with the wedge 38 under the front 56 of the disconnector 50. As a result, the hook 60 on the disconnector is positioned to engage the notch 22 of the hammer. This engagement prevents the hammer from rotating forward again even though the trigger remains pulled.

FIG. 16 illustrates the improved trigger group for semi-automatic firearms 10 of the present invention. More particularly, the trigger group for semi-automatic firearms 10 is shown in binary mode with the safety selector assembly 74 pointing at the 9 o'clock position. The trigger 62 has been relaxed forward to the moment where the disconnector 50 releases the hammer 12.

Figure 17:
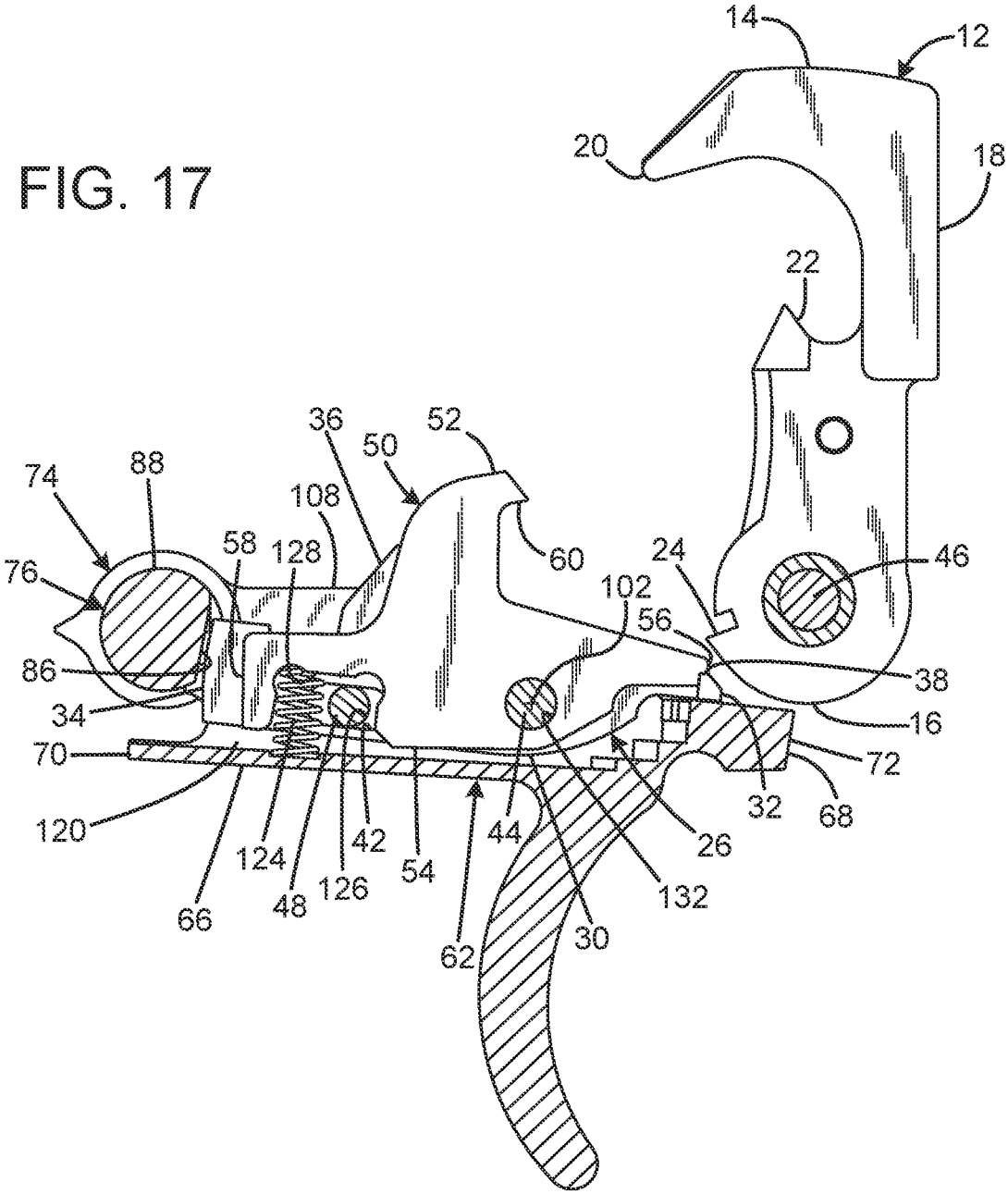
FIG. 17 is a right side sectional view of the trigger group for semi-automatic firearms of FIG. 1 with the safety selector in binary mode at the moment of a release shot.

FIG. 17 illustrates the improved trigger group for semi-automatic firearms 10 of the present invention. More particularly, the trigger group for semi-automatic firearms 10 is shown in binary mode with the safety selector assembly 74 pointing at the 9 o'clock position. The introduction of the wedge 38 under the front 56 of the disconnector 50 has temporarily modified the trigger-to-disconnector geometric relationship so the sear 72 cannot catch the hammer when the hammer is released by the disconnector. Unlike semi-automatic mode, the sear on the trigger 62 is not positioned to catch the notch 24 in the hammer 12 just prior to the hammer disengaging from the disconnector. As a result, the hammer rotates forward again upon release of the trigger, discharging a second round.

Figure 18:
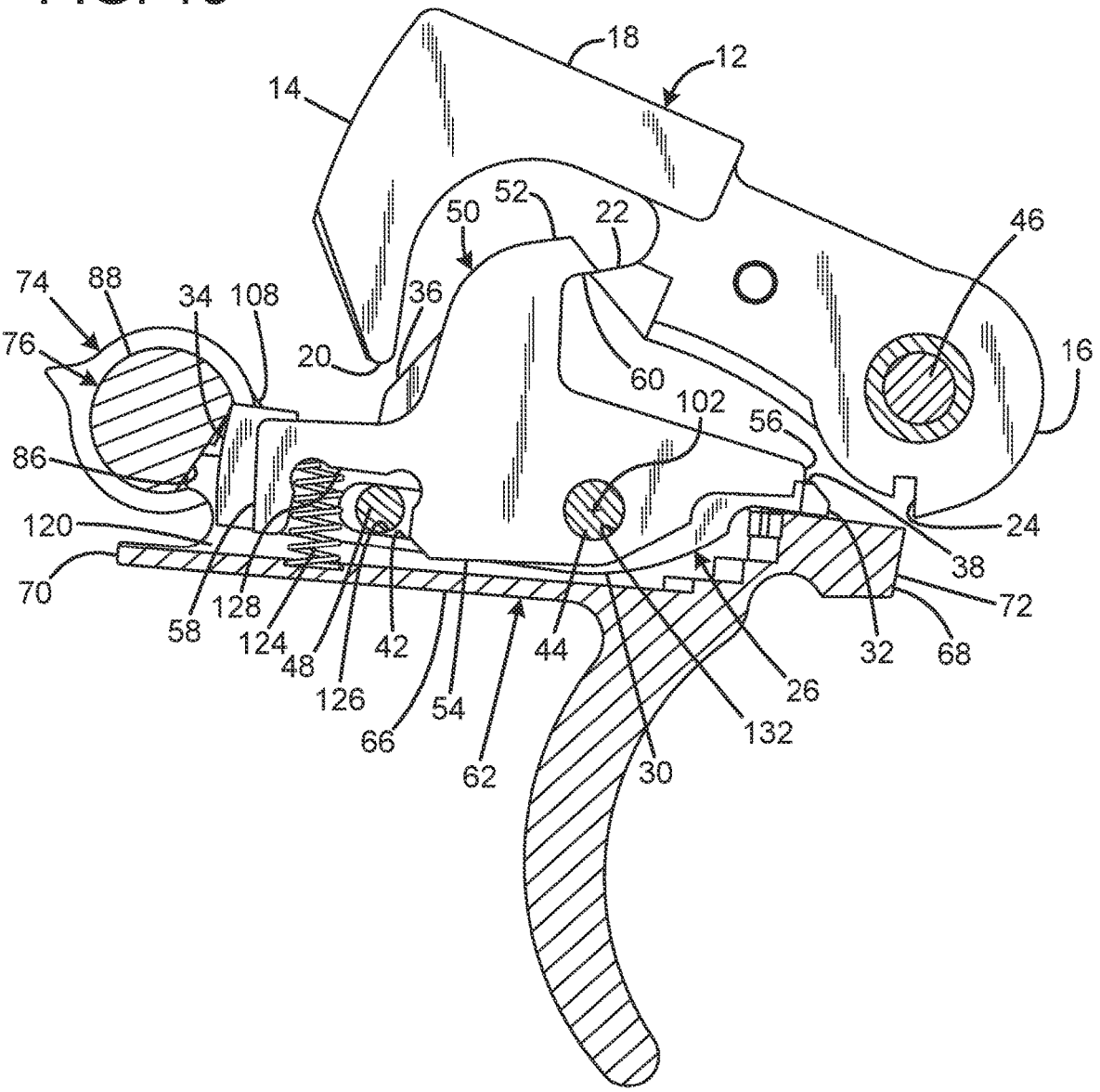
FIG. 18 is a right side sectional view of the trigger group for semi-automatic firearms of FIG. 1 with the safety selector in transition from binary mode to semi-automatic mode to cancel the release shot.
Figure 19:
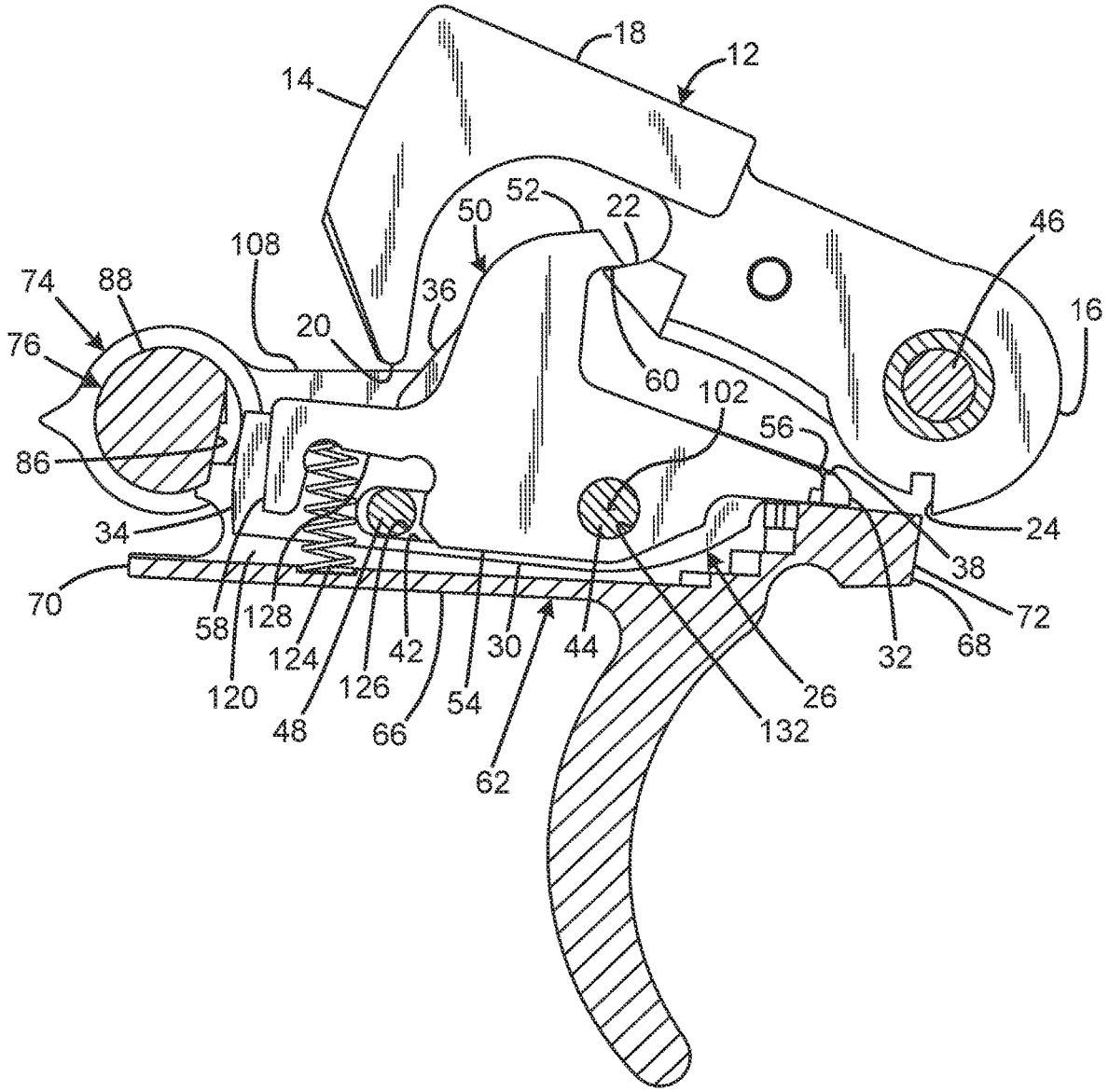
FIG. 19 is a right side sectional view of the trigger group for semi-automatic firearms of FIG. 1 with the safety selector in binary mode, the trigger never having been pulled past the moment of hammer release, and the hammer engaged with the disconnector.

FIGS. 18 and 19 illustrate the improved trigger group for semi-automatic firearms 10 of the present invention. More particularly, the trigger group for semi-automatic firearms 10 is shown transitioning from binary mode to semi-automatic mode with the safety selector assembly 74 pointing at the 9:30 position. The user has the ability to transition from binary mode to semi-automatic mode even after having pulled the trigger 62 in binary mode. This is an important safety feature because it enables the user to cancel the firing of a release shot in binary mode instead of requiring the user to first fire a release shot in binary mode if the trigger has been pulled before transitioning from binary mode to semi-automatic mode. If desired, the user can continue to rotate the safety selector clockwise to return the firearm to safe mode. This can be accomplished even if the firearm is initially in binary mode with the trigger held back waiting to fire a round upon trigger release. The user can manipulate the selector to return the firearm to safe mode while holding the trigger back without discharging the round. This is an incredibly important capability since persons utilizing deadly force must generally cease fire when a threat has been eliminated. To fire a round in such an instance would be a significant liability for the owner of the firearm.

When the user rotates the safety selector assembly 74 to transition from binary mode to semi-automatic mode with the trigger 62 pulled, the safety selector assembly 74 forces the intermittent disconnector spacer 26 forward out of the engaged position. Removal of the wedge 38 from under the front 56 of the disconnector 50 permits the disconnector to rotate forward into semi-automatic mode position while the hook 60 continuously engages the notch 22 on the hammer 12 as the sear 72 moves into position to engage the notch 24 on the hammer. Once the safety selector points to the 12 o'clock position, the disconnector has released the hammer to the sear, and the trigger group for semi-automatic firearms has returned to the position shown in FIG. 7.

FIG. 20 illustrates the improved trigger group for semi-automatic firearms 10 of the present invention. More particularly, the trigger group for semi-automatic firearms 10 is shown in binary mode with the safety selector assembly 74 pointing at the 9 o'clock position. The trigger 62 has been released slowly enough that the rear 20 of the hammer 12 can be depressed in time to hit the rear ramp 36 of the intermittent disconnector spacer 26 to force the intermittent disconnector spacer out of engagement. Disengagement of the intermittent disconnector spacer keeps the disconnector 50 in position to catch the hammer 12, thereby changing the disconnector-to-trigger relationship so the subsequent release of the trigger will cause a normal semi-automatic disconnect.

FIG. 21 illustrates the improved trigger group for semi-automatic firearms 10 of the present invention. More particularly, the trigger group for semi-automatic firearms 10 is shown in binary mode with the safety selector assembly 74 pointing at the 9 o'clock position. In FIG. 21, the trigger 262 has been released too quickly for the rear 20 of the hammer 12 to be able to be depressed in time to hit the rear ramp 36 of the intermittent disconnector spacer 26 to force the intermittent disconnector spacer out of engagement. As a result, the hammer is engaged by the sear 72 of the trigger, and the intermittent disconnector spacer remains and engagement. Because a permanently engaged intermittent disconnector spacer would be subjected to legal restrictions, the next hammer release must disengage the intermittent disconnector spacer as shown in FIG. 22.

FIG. 22 illustrates the improved trigger group for semi-automatic firearms 10 of the present invention. More particularly, the trigger group for semi-automatic firearms 10 is shown in binary mode with the safety selector assembly 74 pointing at the 9 o'clock position. The trigger 62 has been pulled rearward to the moment of hammer 12 release, which has disengaged the sear 72 from the notch 24 on the hammer. The disengagement has enabled the hammer to rotate forward under spring pressure to hit the firing pin to discharge a round. Gas pressure resulting from the discharge of the round has driven the bolt carrier group 148 (not shown) rearward. The bottom 150 of the bolt carrier group has partially depressed the top 14 of the hammer. The user can then leave the trigger in position, which will cause the rear 20 of the hammer to hit the rear ramp 36 of the intermittent disconnector spacer 26 to disengage the intermittent disconnector spacer. The user can also pull the trigger further rearward, which will return the trigger group for semi-automatic firearms 10 to the state shown in FIG. 15 for a release shot, or the user can release the trigger, which will return the trigger group for semi-automatic firearms 10 to the state shown in FIG. 12.

While the positions the disconnector 50 occupies when the intermittent disconnector spacer 26 is engaged and disengaged differ in seemingly minor ways, these slight changes in geometry affect what gun designers refer to as the "timing" of the trigger group 10. These changes in geometry are normally used to provide the proper function for a conventional semi-automatic rifle (especially to prevent it from being readily modified) or for full-automatic or select fire machine guns.

When the intermittent disconnector spacer 26 is disengaged, the disconnector 50 has a forward limit of forward motion that is greater than when the intermittent spacer is engaged. Because of the geometry of the disengaged position of the intermittent disconnector spacer 26, the disconnector operates to catch the hammer 12 as the hammer is pushed back by the bolt carrier group 148 after firing, even while the trigger 62 is still pulled back from a shot. When the trigger is released, the geometry of the disconnector in the disengaged position provides that the trigger sear 72 is elevated adequately by the time the hammer swings forward slightly, so the hammer sear surface 24 catches on the sear, readying the trigger for firing.

When the intermittent disconnector spacer 26 is engaged and shifts the disconnector rearward so the disconnector's forward facing hook 60 engages the hammer 12 in a different position, the slightly different timing geometry gives a different result when the trigger 62 is released. Instead of releasing the hammer to the sear 72, the different geometry allows the hammer sear surface 24 to bypass the sear, and the hammer to fly forward to fire a shot. The bolt cocks back the hammer, where the disconnector catches the hammer while the trigger remains pulled back under most circumstances when the intermittent disconnector spacer is disengaged. When the intermittent disconnector spacer is engaged, the disconnector is shifted into a specific position to catch the hammer when the trigger is pulled back where the trigger sear cannot catch the hammer when the hammer is subsequently released by the disconnector.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a trigger group for semi-automatic firearms has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although an AR-15 is disclosed, the invention is suitable for use with a wide variety of firearm platforms including the M-16 and AR-10; firearms manufactured by Heckler & Koch GmbH of Germany including the MPS, HK91, HK93, and SR9; and firearms manufactured by Sturm, Ruger & Co., Inc. of Newport, NH including the 10/22®. In addition, the hammer can be a conventional hammer available from manufacturers of the firearm platform in which the trigger group for semi-automatic firearms is installed, or the hammer can be specifically customized for use in the trigger group for semi-automatic firearms.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trigger assembly for a firearm comprising:

a frame;

a hammer connected to the frame and movable between a cocked position and a striking position;

the hammer being biased toward the striking position;

a trigger element connected to the frame and movable by a user between a forward position and a rearward position;

a single selector connected to the frame and movable between at least a safe position, a first position, and a second position;

a disconnector assembly having a hammer engagement facility adapted to selectably engage the hammer;

the disconnector assembly having a disconnector spacer moveable between at least a first condition being held disengaged by the hammer and a second position being engaged;

the disconnector assembly movable between a first control condition and a second control condition;

the disconnector assembly operable to move in a first range of motion when in a first control condition; and the disconnector assembly operable to move in a shorter range of motion different from the first range of motion when in a second control condition, such that the trigger assembly operates in a first mode when the selector is in the first position, and in a second mode when in the second position.

2. The trigger assembly of claim 1 wherein in the first mode the hammer moves to the striking position only in response to pulling the trigger to the rearward position, and in the second mode the hammer moves to the striking position in response both to pulling the trigger to the rearward position and releasing the trigger to the forward position.

3. The trigger assembly of claim 1 wherein the disconnector assembly is free of direct contact with the selector.

4. The trigger assembly of claim 1 wherein the disconnector assembly is pivotally connected to the trigger element, has a hammer retention hook, the disconnector assembly is rotationally biased in a direction with the hammer retention hook biased toward the hammer toward a forward limit, and wherein the forward limit for the first range of motion is farther forward than the forward limit for the second range of motion.

5. The trigger assembly of claim 4 wherein the trigger element includes a sear and the hammer includes a hammer hook adapted for selective engagement of the sear and wherein after the trigger has been pulled to discharge the rifle when the selector is in the first position the sear is spaced apart from the hammer hook by a first amount, and wherein after the trigger has been pulled to discharge the rifle when the selector is in the second position the sear is spaced apart from the hammer hook by a second amount greater than the first amount such that after release of the trigger the hammer is restrained by the sear when the selector is in the first position, and the hammer hook bypasses the sear and the firearm is discharged when the selector is in the second position.

* * * * *